US007984898B2

(12) United States Patent
Sanmiya et al.

(10) Patent No.: US 7,984,898 B2
(45) Date of Patent: Jul. 26, 2011

(54) BOOKBINDING METHOD AND BOOKBINDING UNIT, AND IMAGE-FORMING SYSTEM

(75) Inventors: Shigeyuki Sanmiya, Nakakoma-gun (JP); Kazuyuki Kubota, Minamikoma-gun (JP); Yoshito Nakagomi, Kai (JP); Hiroshi Nakagomi, Minami-Alps (JP); Hideya Fujihara, Nirasaki (JP); Atsushi Tsuchiya, Minami-Alps (JP)

(73) Assignee: Nisca Corporation, Minamikoma-gun (JP)

( * ) Notice: Subject to any disclaimer, the term of this patent is extended or adjusted under 35 U.S.C. 154(b) by 336 days.

(21) Appl. No.: 12/172,210

(22) Filed: Jul. 11, 2008

(65) Prior Publication Data

US 2009/0035016 A1 Feb. 5, 2009

(30) Foreign Application Priority Data

Jul. 11, 2007 (JP) ..... 2007-182603

(51) Int. Cl.
*B65H 37/04* (2006.01)

(52) U.S. Cl. ..... 270/58.07; 270/58.08; 270/58.11; 270/21.1

(58) Field of Classification Search ..... 270/58.07, 270/58.08, 58.11, 20.1, 4, 12, 21.1, 17, 18; 412/6, 8, 16, 18, 33, 37
See application file for complete search history.

(56) References Cited

U.S. PATENT DOCUMENTS

| | | | | |
|---|---|---|---|---|
| 6,029,968 | A * | 2/2000 | Honegger | 270/37 |
| 6,592,056 | B2 * | 7/2003 | Yamakawa et al. | 239/569 |
| 7,527,255 | B2 * | 5/2009 | Miyake et al. | 270/58.09 |
| 2006/0249893 | A1 * | 11/2006 | Kubo et al. | 270/58.08 |
| 2007/0048109 | A1 * | 3/2007 | Fujii et al. | 412/33 |
| 2007/0085256 | A1 * | 4/2007 | Miyake et al. | 270/52.18 |
| 2008/0237962 | A1 * | 10/2008 | Kubota et al. | 270/21.1 |
| 2008/0303201 | A1 * | 12/2008 | Honmochi et al. | 270/58.08 |
| 2008/0308992 | A1 * | 12/2008 | Hommochi et al. | 270/58.08 |

FOREIGN PATENT DOCUMENTS

| | | | |
|---|---|---|---|
| JP | 2005-335262 | A | 12/2005 |
| JP | 2006-076779 | A | 3/2006 |

* cited by examiner

*Primary Examiner* — Leslie A Nicholson, III
(74) *Attorney, Agent, or Firm* — Judge Patent Associates

(57) ABSTRACT

First document/image data is printed onto a sequence of sheets that includes sheets of a given size, and sheet(s) of a size that in at least one dimension is larger than the sheets of the given size. At the same time the first document/image data is being printed, second document/image data, i.e., foldout data, is printed onto the outer margin, i.e., a foldout portion, of the sheet(s) of the larger size. The larger-size, foldout sheet(s) is then folded so as to be creased near its overlap with the given-size sheets, and is collated into the sequence of the given-size sheets to form a bundle that is then bound. Thereafter trimming to size the non-bound edge(s) of the bundle slices away the crease in the foldout sheet, leaving the foldout cut-away as an insert tucked into the booklet.

12 Claims, 12 Drawing Sheets

BOOKBINDING METHOD AND BOOKBINDING UNIT, AND IMAGE-FORMING SYSTEM

BACKGROUND OF THE INVENTION

1. Technical Field

The present invention—involving bookbinding methods and image-forming systems for binding the spine endface of sheet blocks having been collated into bundles to finish the bundles into booklets—relates to a method and device for inserting foldout printing leaves into a bookbinding-processed sheet bundle.

2. Description of the Related Art

Generally, this kind of image-forming system is known in the art to have a bookbinding unit connected to an image-forming unit such as a printer and the like to collate printed sheets into a sheet bundle and bind a spine edge of the sheet bundle using adhesive or the like. A system configuration that folds sheets conveyed from an image-forming apparatus using predetermined specifications such as a single fold or a gate fold and the like and collates the sheets is known.

For example, Japanese Unexamined Pat. App. Pub. No. 2005-335262 discloses an image-forming system in which sheets on which images have been formed in an image-forming apparatus (printed sheets) are conveyed to a bookbinding unit and are collated and stacked into bundles in the bookbinding unit, and in which an adhesive paste is applied to the spine-portion endface of the sheet bundles and the sheet bundles are encasing-bound with cover sheets, and afterwards the sheet bundles in book-bound form are finished by trimming true the head, tail, and fore-edge portions.

Further, Japanese Unexamined Pat. App. Pub. No. 2006-076779 discloses a finisher that folds in half or thirds printed sheets produced in an image-forming unit, collates and stacks the sheets, and staple-binds them. Then with this sheet folding unit, both single-folding, whereby a sheet is folded over substantially in half, as well as Z-folding, whereby in divisions into thirds a sheet is folded inward and then is folded outward back onto itself, are proposed. It is to be noted that by the sheet folding unit in this document, a trim-cutting configuration for trimming true the periphery of staple-bound sheets is neither disclosed nor even suggested.

Meanwhile, in image-forming units or printing systems such as just described, foldout leaves are sometimes inserted into the sheets (bundles) bookbinding-processed into booklet form. When, for example, foldouts such as table-of-contents leaves, advertising leaflets, or errata leaves (correction leaves) are to be fit into booklets, the method adopted traditionally has been to interject-insert such leaves following the bookbinding process.

Thus, as just noted, in bookbinding and finishing systems that form predetermined images on sheets, and collate and stack the sheets and bind together their spine-portion edges, foldout leaves are sometimes inserted in post-bookbinding-process booklets. Conventionally, foldout leaves are printed separately from the book-forming sheets, and they are interject-inserted into the booklets. Consequently, a problem with inserting interjection leaves such as table-of-contents leaves, advertising leaflets, or errata/correction leaves is that it requires the considerable labor of producing images on the leaves, and of the interjection operation, etc., which therefore raises the job costs.

Particularly with conventional bookbinding methods that insert foldout leaves after the bookbinding process, because inserting a foldout leaf between specific pages with images demands an extremely complex operation, foldout leaves are inserted between arbitrary pages. Accordingly, inserting printed leaves corresponding to a specific image page, such as errata tables or supplementary explanations relating to the image page, has presented difficulties.

BRIEF SUMMARY OF THE INVENTION

Therefore, the inventors came upon the idea of forming images on large-sized sheets with predetermined image data and simultaneously printing foldout images an outside a region (a blank portion of the sheet) of a predetermined size when sequentially forming images on sheets of predetermined sizes based on a series of image data. Then, an area formed with the foldout image is folded by sheet folding means, and then the bookbinding process is applied to the sheet bundle. Then, when trimming true edges using trimming means, the foldout image area is cut free. With this, it is possible to insert a foldout leaf to correspond to a predetermined image on a page in a bound sheet bundle without requiring any special processes.

An object of the present invention is to provide an image-forming system and bookbinding method that can easily insert a foldout leaf in the bookbinding processes of collating and stacking sheets formed with images and binding the spine edges.

Furthermore, the present invention provides an image-forming system that can insert a foldout leaf such as a correction table and the like between predetermined pages of a bound sheet bundle simultaneously to the bookbinding process.

The present invention employs the following configuration to attain the aforementioned objects. The bookbinding method that collates sheets formed with images into a sheet bundle and binds a spine portion to form a booklet has an image-forming step for sequentially forming images on a plurality of sheets based on predetermined image data; a folding step that folds the sheets formed with images at the image-forming step; a stacking step that collates into a sheet bundle sheets formed with images at the image-forming step and/or sheets folded at the folding step; a bookbinding step that binds a spine portion of the sheet bundle collated at the stacking step; and a trimming step that trims at least a fore-edge portion of the sheet bundle bound at the bookbinding step.

Also, at the image-forming step, images are formed on one or a plurality of a series of sheets to be formed with images by setting a foldout-image area on the fore-edge portion. Next, in the folding step, the foldout image area is folded at a folding-back fold location. Also, at the trimming step, the foldout-image area is cut free by cutting the folding position thereby placing the folded portion into the sheet bundle.

Next, at the trimming step, edges of the bound sheet bundle, excluding the bound spine portion, are trimmed. This step trims true the head and tail portions of the sheet bundle, then trims the fore-edge portion last.

In the image-forming step, a series of images are formed by setting an image area on a predetermined size of sheet and images are formed in parallel on a sheet of a size larger than this predetermined size by setting an image area and a foldout image area thereupon. Next, at the folding step, the foldout-image area is folded at a folding-back fold location. That folding position is set to substantially match the fore-edge portion of the sheet of a predetermined size.

A data processor that has a series of image data and at least one foldout image data, image-forming means that forms images on sheets based on image data from the data processor, sheet folding means for folding sheets from the image-forming means, stacking means that collates and stacks sheets from the image-forming means, bookbinding means that binds a spine portion of the sheet bundle conveyed from the stacking means, trimming means for trimming at least a fore-edge portion of the sheet bundle bound by the bookbinding means, and control means for controlling the image-forming means, the sheet folding means and the trimming means are provided.

The control means is configured (1) to control the image-forming means to sequentially form images on sheets based on the series of image data and to form images of at least one selected image data on the same sheet in parallel to the folded-image data; (2) to control the sheet folding means to fold the sheet with the foldout image formed at a folding-back fold location; and (3) to control the trimming means to trim at a position to cut free the folding position.

The control means controls the image-forming means to form images on sheets of a predetermined size based on the series of image data and to print at least one of the selected image data and folded-image data on a sheet of a larger size than the image data of the predetermined size. The foldout image is formed at the outside of the sheet of a predetermined size.

The control means sets the folding position to a position where it is not cut by the trimming means when the sheet formed with images based on the series of image data is being folded. Furthermore, the control means is configured to control the sheet folding means when folding back the foldout image to set that folding position to a position where it is cut free by the trimming means.

The trimming means has sheet bundle orientation deviation means that changes the posture of the bound sheet bundle by gripping it. The sheet bundle orientation deviation means is configured to change the posture of the sheet bundle by gripping the area of the sheet to be inserted where foldout image is formed.

The present invention has the following effects because the system to which it is applied forms images on sheets based on a series of image data, and simultaneously forms a series of image data and foldout images based on folded-image data on one or a plurality of sheets, folds and binds the foldout image area of the sheet, then trims the folding position of the fold-out-image area.

It is possible to insert a foldout leaf such as a table of contents, advertisement or bookmarker and the like without needing special paper insertion work (processes) because the foldout image is formed at the same time as the series of images, and the folding position is cut free after the bookbinding process.

Particularly, it is possible to fold a foldout image between predetermined pages and to accurately fold a corrections table or supplementary explanation into necessary pages (conventionally a difficult process) because foldout images are formed simultaneously on predetermined image sheets, and the folding position is cut free after the bookbinding process. Therefore, there is a wide application of use for foldout images. It is possible to diversify bookbinding styles and editing work.

Also, the present invention provides a system configuration that collates and binds sheets formed with images, and trims true three edges, excluding the spine binding edges, after the bookbinding process, and does not require special mechanisms. With the present invention, it is possible to create foldout leaves using ordinary bookbinding processes (mechanisms), and this makes for a low-cost bookbinding process.

BRIEF DESCRIPTION OF THE SEVERAL VIEWS OF THE DRAWINGS

FIG. 4A shows a gate fold; 4B shows a Z fold; 4C shows ¼ Z fold; 4D shows a foldout image;

FIG. 5A shows cutting a fore-edge portion of the sheet bundle; FIG. 5B shows cutting the fore-edge of the sheet bundle when the cover sheet is shorter than the inner leaves of sheets; 5C shows cutting the fore-edge of the sheet bundle when the cover sheet is longer than the inner leaves of sheets; and FIG. 5D is a plan view of the sheet bundle, showing head, tail, and fore-edge trim lengths, and their correspondence to a larger-size sheet on which a foldout image is printed, and having been folded as in FIG. 4D and cut along the fore-edge fold to finished sheet size.

DETAILED DESCRIPTION OF THE INVENTION

Overall Structure

Figure 1:
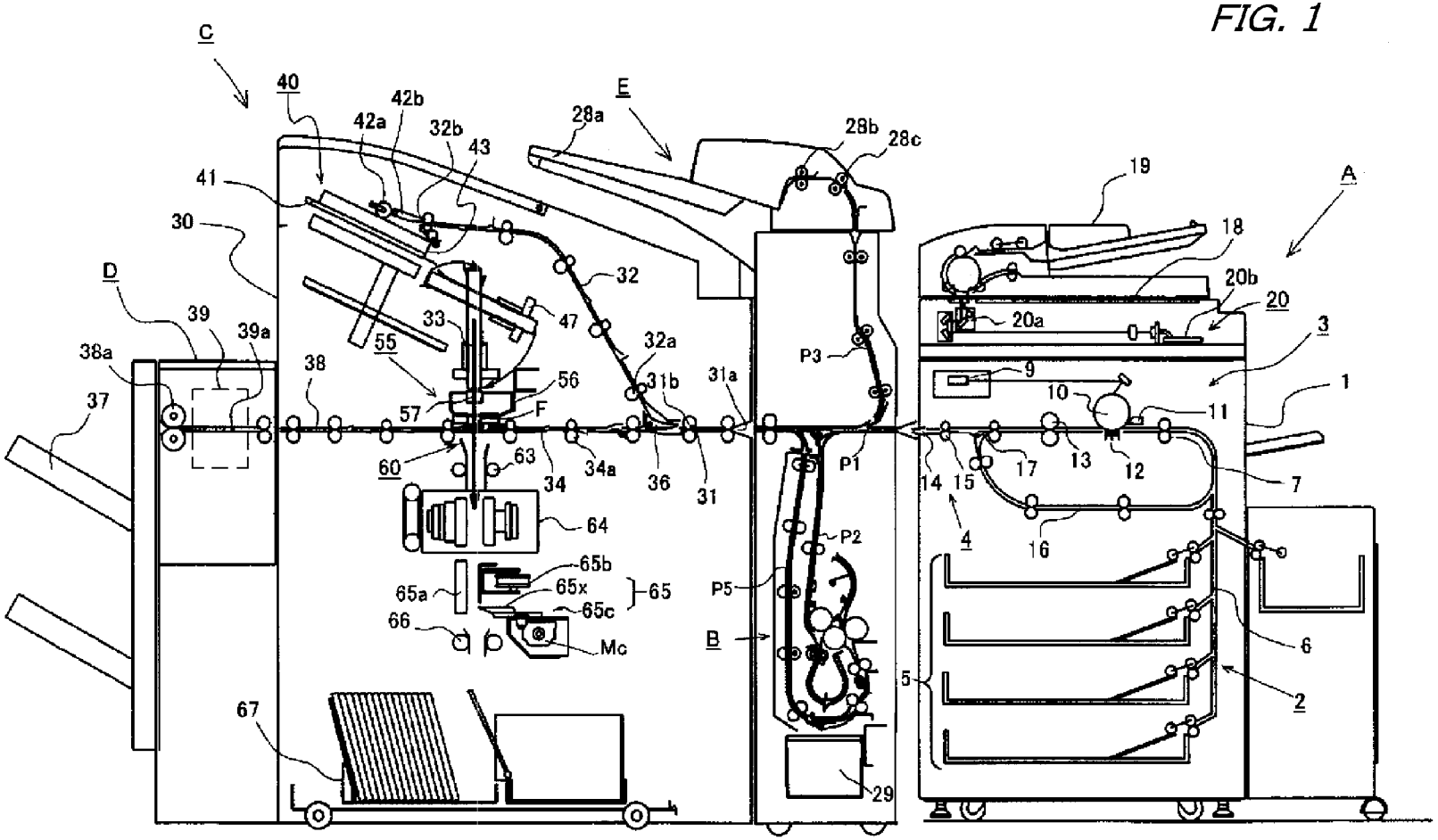
FIG. 1 is an explanatory view of an overall configuration of an image forming system equipped with the bookbinding apparatus of the present invention.
Figure 2:
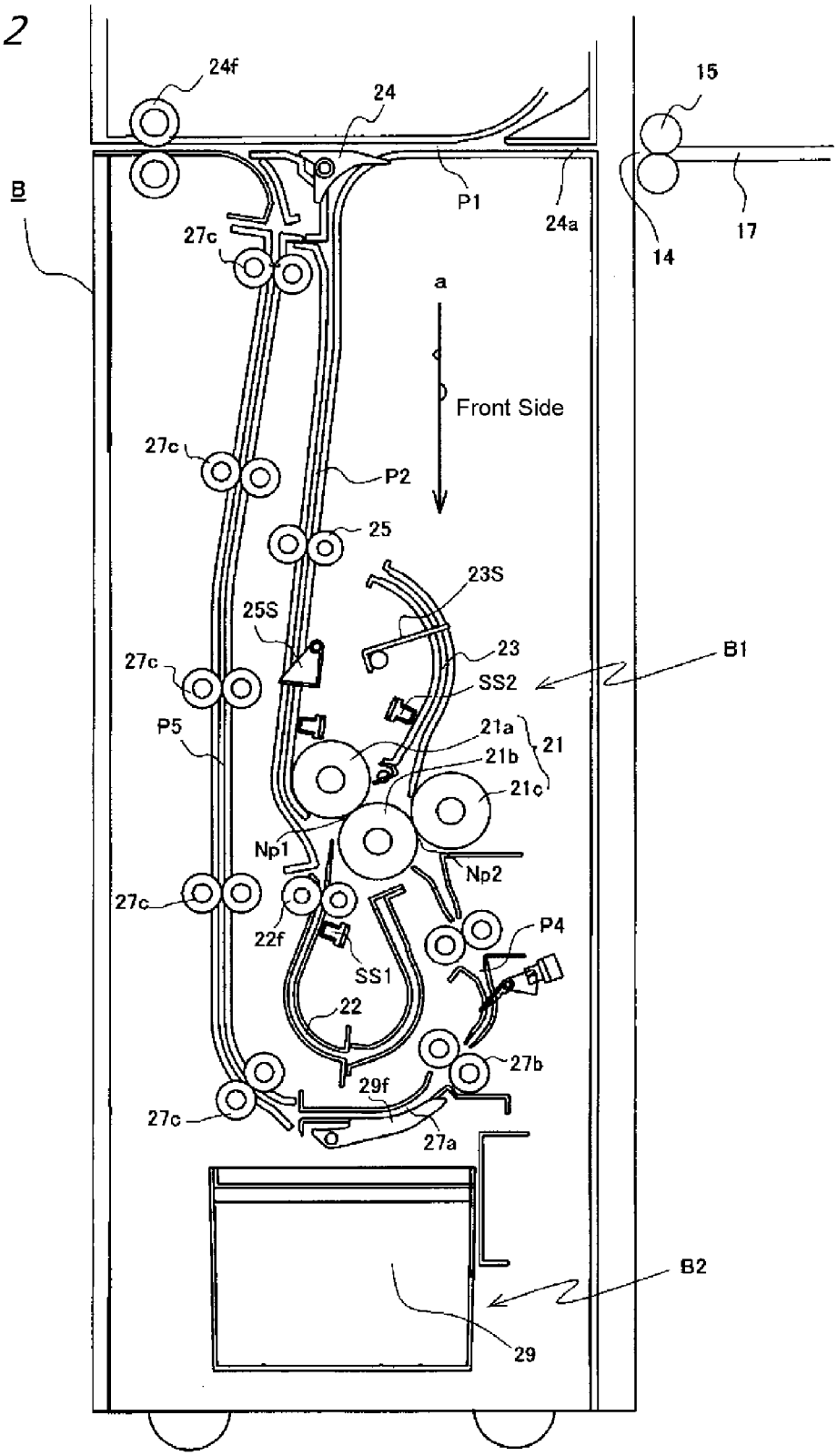
FIG. 2 is an explanatory view of a sheet folding unit in the system shown in FIG. 1.
Figure 3:
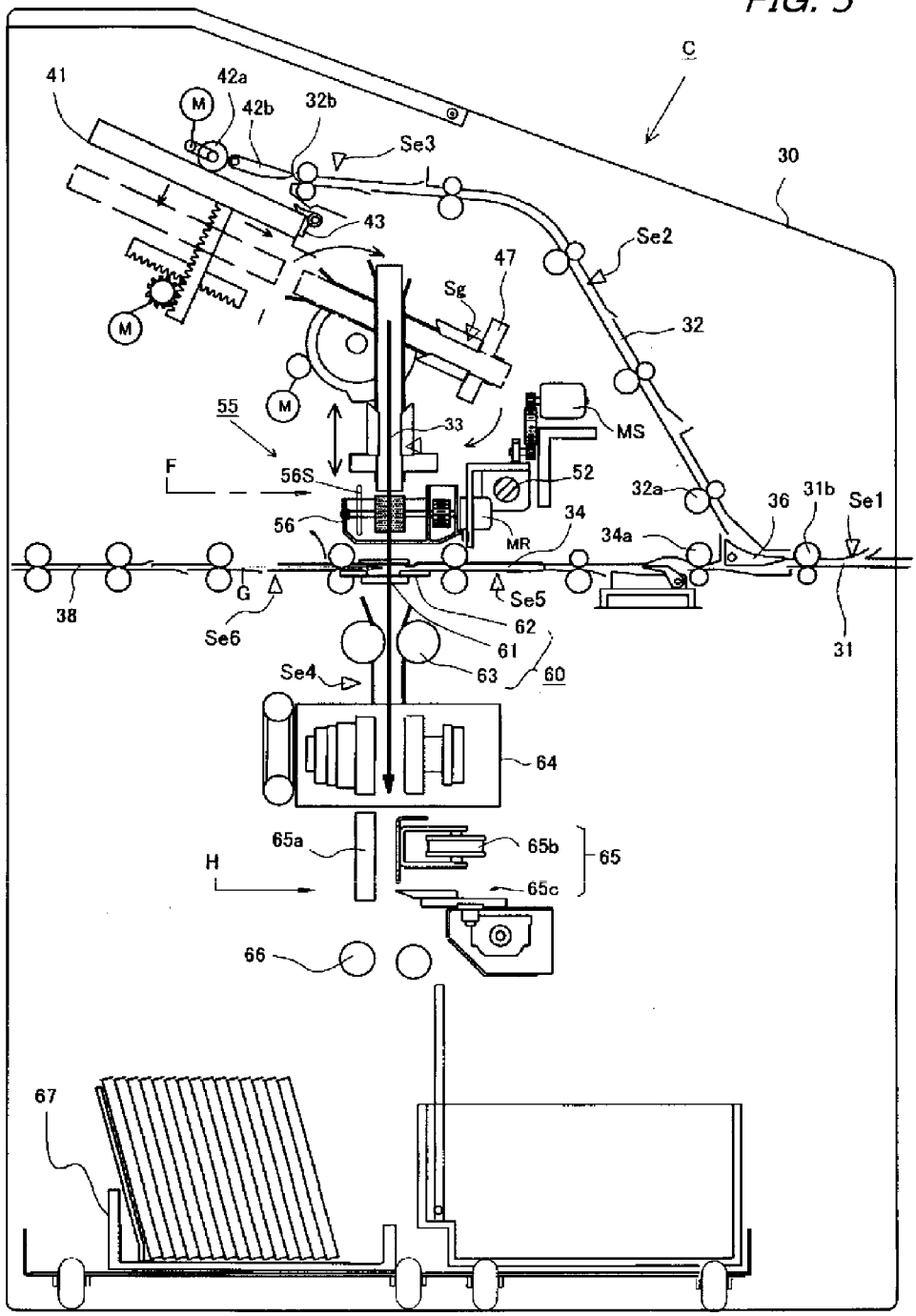
FIG. 3 is an explanatory view of a configuration of a bookbinding unit in the system of FIG. 2.

A preferred embodiment of the present invention will now be explained based on the drawings provided. FIG. 1 is an overall view of a configuration of the image-forming system according to the present invention; FIG. 2 is a view of a configuration of the sheet folding unit; and FIG. 3 is an explanatory view of a configuration of the bookbinding unit.

Image-Forming System Configuration

The image-forming system shown in FIG. 1 is composed of an image-forming unit A that forms images on sheets; a sheet folding unit B that folds sheets formed with images into predetermined shapes; and a bookbinding unit C that performs a bookbinding process on sheets fed from these units. A finisher unit D is linked downstream of the bookbinding unit C. These units are disposed to convey sheets from with images at the image-forming unit A sequentially downstream to the sheet folding unit B, the bookbinding unit C and then to the finisher unit D. The sheet folding unit B folds sheets using predetermined specifications such as a single fold or in thirds, then sends the folded sheet to the bookbinding unit C. The bookbinding unit C collates into sheet bundles folded sheets or sheets fed from the image-forming unit A and then binds the spine edge of the sheet bundle. For that reason, a bookbinding means 55 such as an adhesive binding means or stapler binding means is disposed in the bookbinding unit C. Trimming means 65 is disposed downstream of this bookbinding means 55 to trim and align three sides of a bound sheet bundle, excluding the spine portion thereof.

Each unit will be described in detail below. However, a feature of the present invention is that the image-forming unit A, the sheet folding unit B, and the bookbinding unit C are disposed downstream in that order. An image data processor 18*d* is provided in the image-forming unit A shown in FIG. 1. A series of image data da1 and foldout image data da2 are prepared in the processor 18*d*. In other words, the image data processor 18*d* is a memory means (for example, a hard disk), and image data da1 that finishes the bookbinding process and foldout image data da2 that is inserted into the sheet bundle after bookbinding process are stored therein. In addition to that, it is also acceptable to configure the image data processor 18*d* to transfer the image data da1 and foldout image data da2 from an external device (such as a PC).

Images are formed sequentially using the image data da1 specified by the operator on a predetermined size at the image-forming unit A. The present invention forms images of one or a plurality of image data da1 on a series of sheets in parallel to forming foldout images with the foldout image data da2 at the same time. For that reason, foldout images are formed on sheets (hereinafter referred to as folding sheets) of a size larger than the predetermined size of sheet specified by the operator. For example, to form an image of image data da1 on a JIS standard A4 size sheet (297 mm×210 mm), an image is formed using an A3 (420 mm×297 mm) size sheet and the sheet is folded. The foldout image is formed outside of the area of the predetermined size of sheet (see FIG. 4D).

The present invention folds the sheet formed with a foldout image as described above at the sheet folding unit B. The foldout image is folded inward or outward at the folding back position. In other words, the foldout image is formed outside of the front edge of the finished size on a sheet larger than the predetermined size (finished size). The folding position is formed in the outside of the finished size.

The predetermined size of sheet and the folding sheet are collated into a bundle in the stacking tray 41. Then, adhesive is applied to the spine of the sheet bundle or the sheet bundle is stapled to form a booklet. Three sides of the bound sheet bundle, excluding the spine portion, are trimmed true by the trimming means 65.

The present invention cuts away the foldout image area of the folding sheet at the folding position when the sides are being trimmed. The folding position of the folding sheet is arranged within the trimming region when trimming the booklet. Therefore, the foldout image formed on the folding sheet is inserted into a predetermined page after the trimming and finishing process.

Furthermore, when folding the sheet formed with images according to the image data da1 into a half or ⅓ folds at the sheet folding unit B, the present invention sets the folding position to be inside the cutting position so it is not cut when cutting using the trimming means 65, and sets the folding position within a cutting amount to be cut when cutting the folding position of the folding sheet with the trimming means 65.

Also, as shown in FIG. 1, the image-forming unit A is equipped with an image-forming means 20 that sequentially forms images on sheets based on predetermined image data da1, and feeding means 2 that feeds sheets thereto. Also, the sheet folding unit B is equipped with a sheet folding means 21 that folds sheets formed with images. The bookbinding unit C is equipped with collecting means 41 that collates and stacks sheets fed from the image-forming means 20 directly or via the sheet folding means 21; cover sheet binding means 60 that covers the collated sheet bundle and binds a cover sheet thereto; and trimming means 65 that trims three edges of the sheet bundle bound with the cover sheet to align the edges. An inserter unit (feeding apparatus) E is disposed upstream of the cover sheet binding means 60 on an image-forming system having such a configuration, and in some cases the finisher unit D is disposed downstream of the bookbinding unit C. The inserter unit E feeds the cover sheet to the cover sheet binding means 60; the finisher unit D is equipped with a finishing means 39, such as stapling means that staples sheets, hole-punching means, and stamping means and the like, that aligns sheets fed from the image-forming means 20 or the sheet folding means 21 into a sheet bundle without the bookbinding process, and a discharge tray 37.

With such a system configuration, images are sequentially formed on sheets using image data da1 stored in a data storage unit provided in the image-forming unit A, or sent thereto, and these sheets are folded, collated and collected. Thereafter, the collated sheet bundle is covered by a cover sheet to form a booklet. After the bookbinding process, a finishing process to cut three sides of the sheet bundle, excluding the spine portion of the sheet bundle is possible. (Hereinafter, this is called a bookbinding operation.) At the same time, it is possible to feed sheets formed with images to the finisher unit D passing through the bookbinding unit C without their undergoing the bookbinding process and to be finished at the finisher unit with a process such as stapling, stamping, or hole-punching. (Hereinafter, this is called a finishing operation.) For that reason, in addition to folded sheets fed from the sheet folding unit B are sent to the collecting means 41, and a sheet conveyance path 38 is provided to convey the sheets to the finishing means 39. Therefore, it is possible to select whether sheets formed with images are sent either to the collecting means 41 via the sheet folding unit B for the bookbinding operation, or to the finisher unit D for the finishing operation.

The present invention has a feature to automatically execute processes with this system configuration from the image-forming process to the finishing process with the "print-out mode," "folding mode," "bookbinding mode," and "finishing mode." These modes can be set using a mode setting means 72, as described below, for example, but here the processes of each mode will now be explained.

Print-Out Mode

In this mode, sheets formed with images at the image-forming unit A are stacked on a discharge tray. This mode forms images on sheets of a size specified by the image data da1 in the same way as with an ordinary copier or printer, or of a size specified using an input means (a control panel 71 described below), and stacks and stores the sheets in the discharge tray. The system shown in FIG. 1 stores the sheets in the discharge tray 37 equipped on the finisher unit D at the furthest downstream side.

Folding Process Mode

In this mode, sheets formed with images at the image-forming unit A are finished into a booklet, or folded for the finishing process. Bookbinding folding specifications, staple folding specifications, and the letter folding specifications can be specified for the sheet folding method. Note that the system shown in FIG. 1 is configured so that a sheet folding process folds sheets fed from the image-forming unit A according to the specified folding specifications, and stores folded sheets in a folded sheet storage tray 29 (see FIG. 2), that is separate to bookbinding and finishing processes. Therefore, it is possible for the system to be set to bookbinding, finishing, or to sheet folding operations on sheets formed with images.

The present invention has a feature to determine the folding position N to fold the sheet according to the type of each final finishing process, of "bookbinding, finishing, and sheet-folding" when the system is set for the "folding process mode." In other words, a folding position computing means 73 that sets the folding position N when the sheet folding means 21 disposed in the sheet folding unit B folds the sheet is composed to determine the folding position N using a first control mode and a second control mode.

The first control mode sets the folding position N for the sheet when the "bookbinding finish" is set. This control sets the folding position N so that the folded edge of the folded sheet is not cut when a sheet bundle covered with a cover sheet bound by the bookbinding finish is being trimmed for alignment. For that reason, the folding position computing means 73 is composed to set the sheet folding position N based on a virtual trimming length by computing the trimming length for bookbinding finish as the virtual trimming length.

This virtual trimming length is computed in the following way, using initial setting conditions (setting values) for example for image forming. First, with the initial settings, the finishing mode selection, the sheet size selection and the image-forming area (page layout) are set. When supplying the cover sheet for the bookbinding finishing from the inserter unit E, the operator specifies the size of the cover sheet on the control panel 71. The virtual trimming length first determines the horizontal direction of the sheet from the page layout setting. The cover sheet, the longitudinal length L of the inner leaves of sheets, and the lateral length R are compared to set the trimming position based on the shortest sheet. This is to trim the sheets based on a small sized sheet to align the cover sheet and all the leaves of inner sheets (the sheet bundle).

Figure 5A:
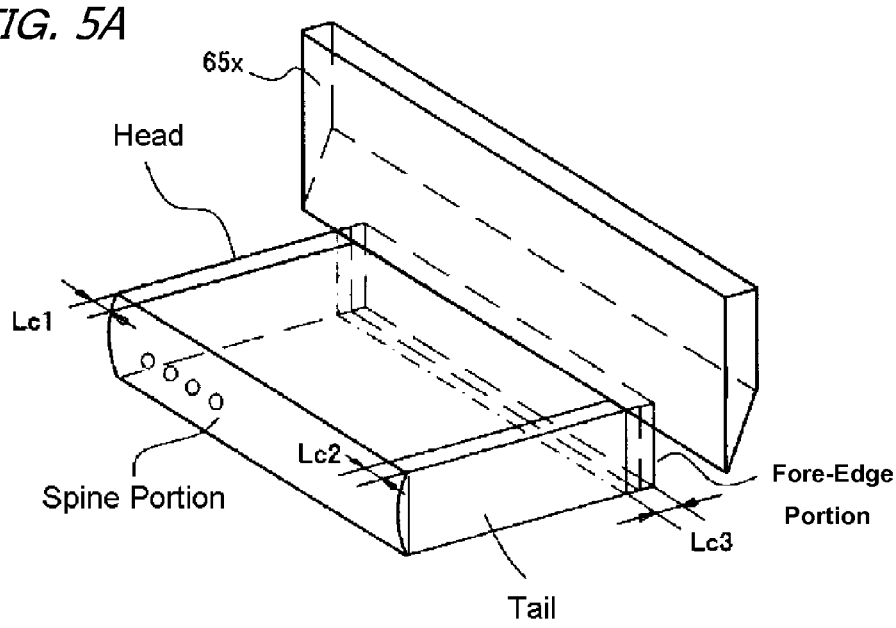
FIGS. 5A to 5D are explanatory views of cutting the sheet bundle in the system shown in FIG. 3.
Figure 5B:
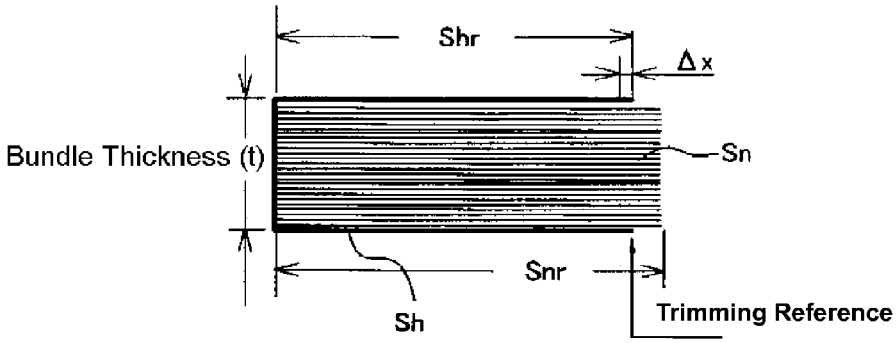

To explain this based on FIGS. 5A and 5B, FIG. 5A shows a case where the cover sheet Sh is shorter compared to the inner leaves of the sheet bundle Sn; at that time, a minimum trimming length Δx is set based on the cover sheet Sh. FIG. 5B shows a case where the inner leaves of the sheet bundle Sn are shorter compared to the cover sheet Sh; at that time, a minimum trimming length Δx is set based on the inner leaves of the sheet bundle Sn.

Note that the comparison of the length between spine bound edge and fore-edge portion edge is calculated by [(sheet length−bundle thickness t)/2] for the cover sheet. In other words, to cover and bookbinding the inner leaves of the sheet bundle Sn with the cover sheet Sh, the cover sheet Sh is folded to form the spine cover at the central portion. The spine cover sheet width at this time substantially matches the thickness of the inner leaves of sheets of the bundle.

However, the spine cover sheet width (the thickness t of the sheet bundle of inner leaves) is determined when images are formed on the inner leaves of sheets to be aligned, and the sheet bundle is aligned in the stacking means. On the other hand, the sheet folding process can be applied on the first sheet. Here, the present invention has a feature to find that "bundle thickness (hereinafter called presumed bundle thickness") t when computing the virtual trimming length, from (1) a tolerable maximum bookbinding thickness, or (2) a number of sheets that were formed with images. The former is set in advance from the apparatus configuration (for example, a maximum gripping amount of a gripping conveyance means 47, described below) of the bookbinding unit C. The latter is determined by multiplying an average sheet thickness (paper thickness) by the number of sheets to be printed that is known by the initial page layout settings.

Therefore, as shown in FIGS. 5A and 5B, the virtual trimming length is computed by subtracting the minimum trimming length ΔX from the short length of either the length of the inner leaves of sheets or the cover sheet length, for the longitudinal length L in the head to tail direction. The minimum trimming length Δx is subtracted from the shorter length by comparing the [(cover sheet length−presumed bundle thickness]/2] as the cover sheet lateral length (Shr) to the lateral length (Snr) of the inner leaves of sheets for the fore-edge direction horizontal length R.

Note that in this case, the minimum trimming length Δx is set in advance based on an amount of position slippage generated in the sheets in the process for sheets formed with images at the image-forming unit A to be collated and stacked in the bookbinding unit C and covered with a cover sheet. In other words, the minimum trimming length Δx is set from the amount of mis-alignment of the head, tail and open side that is generated in the cover sheet Sh and the inner leaves of sheets of the sheet bundle Sn that were bound by the cover sheet binding means 60, described below.

Next, the second control mode sets the folding position N for the sheet when "finishing•sheet folding" are set. This control calculates the folding position according to the preset folding specifications such as a half fold, a standard gate fold, and ⅓ Z-fold and the like which are described below. In such a case, the folding position computing means 73 is configured to calculate the folding position N from the folding specifications and the sheet size (the default value). The configuration of each of the above will be described below.

Bookbinding Mode

This mode stacks and collates in stacking means 41 sheets fed from the image-forming unit A and dispenses adhesive (or adhesive tape) for example to the sheet bundle. Then, this sheet bundle is covered and bound by a cover sheet, and three sides, excluding the bound spine portion, of the sheet bundle are cut for alignment. A portion of the sheets stacked in this stacking means 41 are folded by the sheet folding means 21. Then, the sheet bundle formed into a cut and aligned booklet is stored in a storage stacker 67.

Finishing Mode

This mode conveys sheets from the image-forming unit A directly into a processing path (hereinafter referred to as a finishing path 39*a*) via the bookbinding unit C after being folded at the sheet folding unit B. After undergoing a finishing process by the finishing means 39, such as a stapling means, stamping means or a hole-punching means and the like prepared in this path, the sheets are conveyed out to the discharge tray 37.

Image-Forming Unit Configuration

The following will now explain the image-forming unit A shown in FIG. 1. The image-forming unit A can adopt a variety of structures of a copier, printer or printing machine. The drawing shows an electrostatic printing system. This image-forming unit A has a feeding unit (feeding means) 2, printing unit 3, discharge unit 4 and control unit in the casing 1. A plurality of cassettes 5 corresponding to sheet sizes is prepared at the feeding unit (feeding means) 2. Sheets of the size specified by the control unit are fed to the sheet feed path 6. A registration roller 7 is equipped at the sheet feed path 6. After the leading edge of the sheet is registered by this roller, it is fed at a predetermined timing to the downstream printing unit.

A static electric drum 10 is equipped at the printing unit 3. A print head 9, a developer 11 and a transfer charger 12 are disposed around this drum 10. The print head 9 is composed of a laser emitter, for example, to form electrostatic latent images on the electrostatic drum 10. Toner ink adheres to the latent image at the developer 11, and this is transferred and printed on the sheet at the transfer charger 12. The printed sheet is the fixed at the fixer 13 and discharged to the discharge path 17. A discharge outlet 14 formed in the casing 1 and a discharge roller 15 are disposed at the discharge unit 4.

Note that the symbol 16 in the drawing represents a recirculation path. A printed sheet from the discharge path 17 is turned over from front to back at the switchback path and fed to the registration roller 7 to be formed with images on its backside. In this way, a sheet formed with images on one side or both sides is conveyed from the discharge outlet 14 by the discharge roller 15.

Note that the symbol 20 in the drawing is a scanner unit (image-forming means). This optically reads original images to print using the print head 9. As is generally known in the art, the scanner is composed of a platen 18 where an original sheet is set; a carriage 20*a* that scans the original image along the platen 18; and an optical reading means (for example, a CCD device) 20*b* that photo-electrically converts optical images received from the carriage 20. The drawing shows an original feeding apparatus 19 that automatically feeds the original sheet to the platen, installed over the platen 18.

Sheet-Folding Unit Configuration

The following will now describe the configuration of the sheet folding unit B. The sheet folding unit B is composed of a folding unit B1 and a folded sheet stacker B2. A conveyance inlet 24*a* linked to a discharge outlet 14 of the image-forming unit A is equipped in the sheet folding unit B, and a sheet conveyance path P1 that sends sheets from the conveyance inlet 24*a* to the bookbinding unit C, described below, is connected to traverse the apparatus. A folding process path P2 and a sheet feed path P3 from the inserter unit E are branchingly connected to the sheet conveyance path P1.

Sheet Folding Specifications

The following will now explain the folding specifications performed by the sheet folding unit B1. Folding sheets in half or in thirds are the types of folds (folding specifications) that are commonly applied with the image-forming system described above. Each type of sheet fold will now be explained.

Single Fold

This creases or folds a sheet conveyed out from the image-forming unit A at substantially the half position of the length of the direction of conveyance. Although not shown, the sheet is folded in half at a central position. The folded ends of sheets can then be bound by stapling or gluing and the like to form a closed-end document. Furthermore, if holes are punched into the folded sheets, they can be used in a variety of document organizing methods, such as filing. The folding position computing means 73 that sets the folding position N uses the first control mode for the bookbinding operation, and the second control mode for the finishing and sheet folding operations.

Gate Fold

Figure 4A:
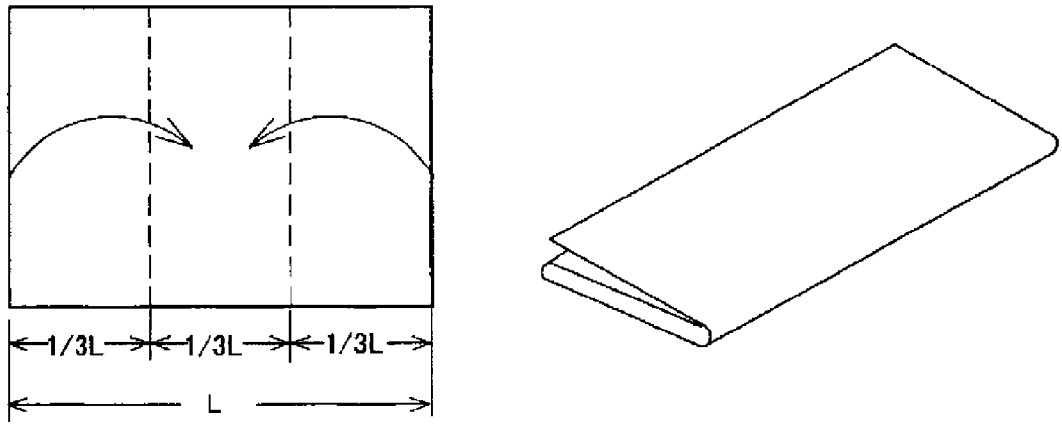
FIGS. 4A to 4D are explanatory views of examples of folding specifications in the system shown in FIG. 2.

In this folding method, the sheet is folded at desired positions (for example at ⅓ positions) of the leading edge and the trailing edge of the sheet in the length direction. The two end panels, specifically, the leading and trailing ends of the sheet, are mutually folded inward over a middle third panel. As shown in FIG. 4A, the leading end side of the sheet (in direction of sheet conveyance) is folded at a ⅓ position of the sheet, then the trailing end is folded over that panel at a ⅓ position of the sheet. A gate-folded sheet can be inserted into an envelope as a letter.

Therefore, with this folding specification, folded sheets are stored a folded sheets in a sheet storage tray 29 equipped on the sheet folding unit B. In such a case, the folding position computing means 73 sets the folding position with the second control mode.

Z-Fold

Figure 4B:
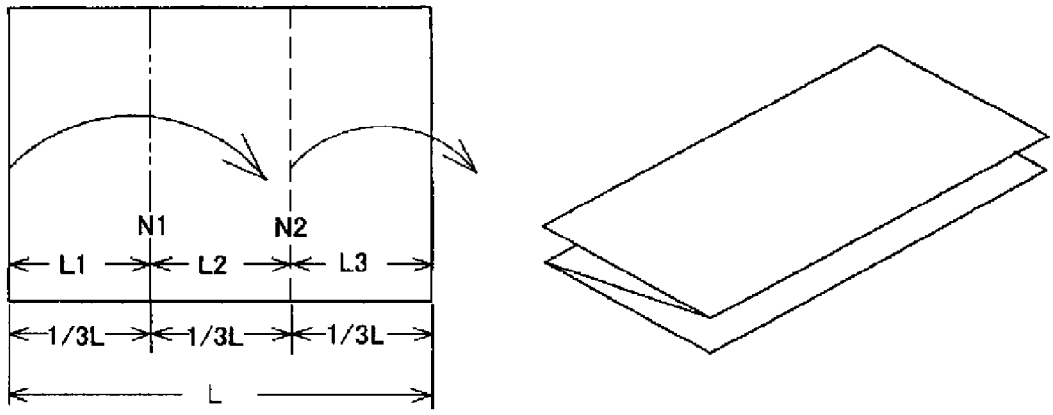
Figure 4C:
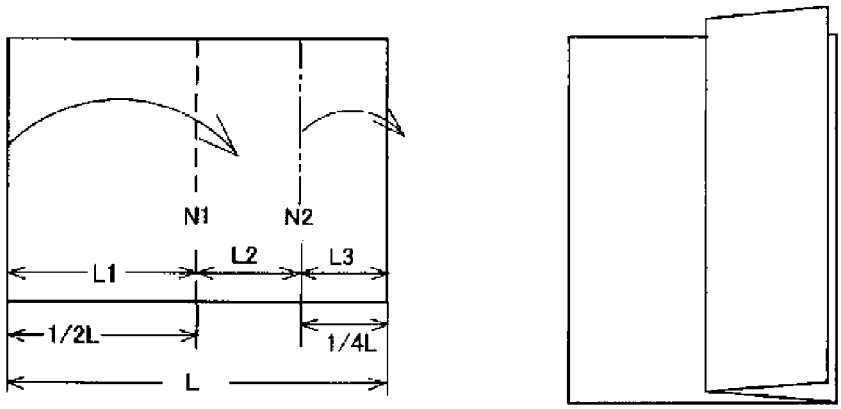
Figure 4D:
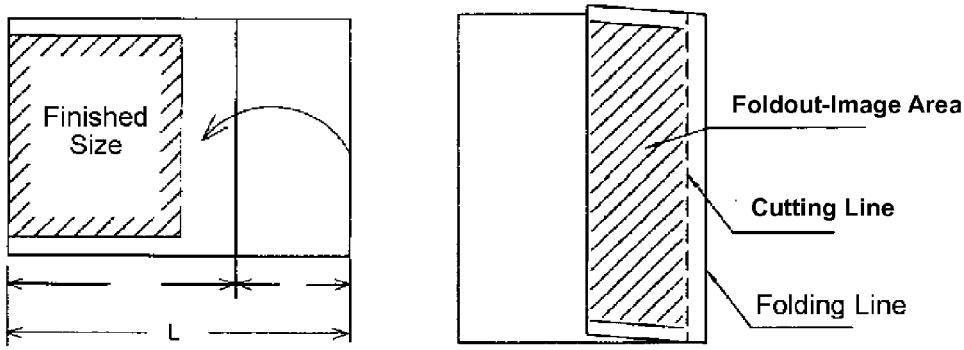

In this folding method, the sheet is folded at desired ⅓ positions of the leading edge and the trailing edge of the sheet in the length direction of sheet conveyance. Specifically, the leading and trailing ends of the sheet are folded in opposite directions. The leading edge of the sheet is folded inward, and the trailing edge of the sheet is folded outward. If a sheet is folded at ⅓ positions as shown in FIG. 4B, it can be inserted into an envelope as a letter. If the sheet is folded at a half position inward, and a ¼ position is folded outward, the sheet can be used for filing. Note that the sheet can be folded for any kind of use by adjusting the inner folding position (N1 in the drawing) and outer folding position (N2) when apply such a Z fold. For example, if the inner folding position N1 is set to ⅓ of the sheet length L, leaving a binding margin at the spine portion, bookbinding is possible. If the folding back position (outer folding position) N2 of the edge is adjusted, it is possible to project the folded back portion so that a letter head portion of the sheet is facing outward so as to be visible.

Specifically, as shown in FIGS. 4(*b*) and 4(*c*), by adjusting the outer folding position N2 so that a relationship of L2<L3 exists, the folded back portion can be projected to the outside of the folded sheet. Also, if the outer folding position N2 is adjusted so that a relationship of L2>L3 exists, the folded back portion can be pulled inside the folded sheet. When in the bookbinding finish mode, the folding position computing means 73 that sets the folding position N at that time sets the folding position using the first control mode; when in the finishing process mode or sheet folding mode, it sets the folding position using the second control mode.

Folding Unit Configuration

The structure of the folding unit B1 will be now explained with reference to FIG. 2. The folding process path P2 is linked to the sheet conveyance path P1 interposed by a path switching flapper 24; the folding roller mechanism (the sheet folding means, and that applies below) 21 is disposed in the folding process path P2. A folded sheet path 23 branched in a T-shape is furnished to the folding process path P2 at a central position of the path, and a switchback path 22 is furnished downstream at a leading end of the folding process path P2. The folding roller mechanism 21 is furnished at the path branching point. The folding roller mechanism 21 shown in the drawing is composed of a first roller 21*a*, a second roller 21*b*, and a third roller 21*c*. The first and second rollers 21*a* and 21*b* are in mutual contact to nip the sheet; the second and third rollers 21*b*, and 21*c* are also in mutual contact to nip the sheet. Therefore, a first folding process is executed at the nipping point (the first folding unit) between the first and second rollers 21*a*, and 21*b*, and a second folding process is executed at the nipping point (the second folding unit) between the second and third rollers 21*b*, and 21*c*.

A conveyance roller 25 that conveys the sheet is disposed in the folding process path P2; the folding roller mechanism 21 is positioned downstream of the conveyance roller. A switchback roller 22*f* that is capable of both forward and reverse rotations and a sheet sensor SS1 are disposed in the switchback path 22 downstream of the folding process path P2. The sensor SS1 detects the leading edge of the sheet fed downstream (FIG. 2) by the switchback roller 22*f*. After the sensor detects the leading edge of the sheet, the switchback roller 22*f* further conveys the sheet a predetermined amount and then stops. Then, the central portion of the sheet is bowed by the conveyance roller 25 continuing to rotate, thereby causing the bowed ¼ position of the sheet to enter the nipping point of the first folding unit Np1 of the folding roller mechanism 21. Next, the switchback roller 22*f* is driven in reverse thereby backing up the leading edge of the sheet. At the same time as that reverse drive, the conveyance roller 25 continues to feed the trailing edge of the sheet. These two actions cause the sheet to enter nipping point between the first and the second rollers 21*a* and 21*b*. These rollers pull the sheet downstream into the folded sheet path 23.

On the other hand, a trailing edge registration stopper 25S is provided downstream of the conveyance roller 25 to calculate the folding position based on the trailing edge of the sheet. After the trailing edge of the sheet is fed past the registration stopper 25S by the switchback roller 22*f*, the switchback roller 22*f* rotates in reverse thereby abutting the trailing edge of the sheet against the registration stopper 25. This causes the sheet to form a bow based on the sheet's trailing edge position. The bowed portion advances into the nipping point Np1 of the first and second rollers 21*a*, and 21*b* (the first folding unit).

Thus, the first folding process is executed based on the trailing edge of the sheet. Note that the sheet stopper mechanism is composed of a flapper-shaped stopper 25S. This stopper 38 is configured to retract from the path when the sheet advances downstream in the folding process path P2, and to advance back into the path when the sheet is being conveyed upstream to stop the trailing edge of the sheet. This stopper that registers the trailing edge of the sheet can also be composed of the conveyance roller 25 as a switchback roller capable of forward and reverse rotations. Switchback roller 22*f* at the leading end of the path can also be configured for position registration.

Sheets whose folding positions are calculated by either their leading edge or their trailing edge when supplied to the first folding unit are folded by the first and second folding rollers 21*a*, and 21*b*, and then conveyed into the folded sheet path 23. A sheet detection sensor S2 and movable stopper 23 are disposed in the folded sheet path 23. The movable stopper 23S is configured to move into the folded sheet path 23 to register the leading edge position of the sheet according to the sheet size and folding specifications. The leading edge of the folded sheet fed by the first and second rollers 21*a*, and 21*b* abuts the movable stopper 23S and is registered. This also forms a bow in the trailing edge side. This bow causes the sheet to advance into the nipping point between the second 21*b* and third roller 21*c* so the trailing edge side of the sheet is folded. A first discharge path P4 is disposed downstream of the nipping point (the second folding unit) Np2 of the second and third rollers 21*b* and 21*c*. Sheets folded at the first and second folding units Np1, Np2 are conveyed out to the first discharge path P4. Note that in the event that the sheet does not require a second folding, for example if only a single fold is applied to the sheet, the movable stopper 23 retracts to a non-operational, standby position so that the sheet can be conveyed out to the first discharge path P4 without being folded at the nipping position of the second and third rollers 21*b* and 21*c*.

The first discharge path P4 is equipped with a conveyance out rollers 27*b*. These rollers nip the folded sheet and convey it to downstream. A folded sheet storage tray 29 and a second discharge path P5 are disposed downstream of the first discharge path P4 interposed by path switching member 29*f*. Conveyance rollers 27*c* are disposed at proper intervals in the second discharge path P5 to convey a folded sheet to the sheet conveyance path P1.

Inserter Configuration

As described above, a printed sheet is conveyed in from the image-forming unit A to the folding unit B1 but in addition to this, a sheet can be selectively conveyed from the inserter E for the folding process. As shown in FIG. 1, the inserter B3 is composed of a feeder tray 28*a* where sheets such as cover sheets or a divider sheet can be set; a separating means 28*b* that separates and feeds one sheet on the tray at a time; and the paper feed path P3 that guides the separated sheet to the sheet conveyance path P1. The separating means 28*b* is ordinarily composed of a friction roller (paper feed roller) and separating roller; a registration roller 28*c* is disposed downstream thereof.

Therefore, it is possible to guide a sheet from a different printing process, not supplied from the image-forming unit A, or to set a cover sheet in the feeder tray 28*a* to insert in front and behind sheets. It is also possible to set divider sheets in feeder tray 28 to insert the dividers into the sheet conveyance path P1 for insertion between the pages at appropriate times.

Sheet Folding Operation

The following will now explain actions of the sheet folding unit B configured as described above. The present invention has the possibility of trimming a folding position N when trimming to align the edges of sheets bound in the bookbinding process when a sheet has been applied with a Z-fold, when applying the bookbinding process at the bookbinding unit C, on sheets folded into a Z-fold at the sheet folding unit B. The present invention has a feature of setting the sheet folding position N according to the trimming amount. The following will explain folding operations to fold a sheet into a Z-fold at the sheet folding unit B.

The control unit 59 of the sheet-folding unit B is composed of a control CPU. The control unit 59 can be integrated to the control unit 70 of the image-forming unit A or the control unit 75 of the bookbinding unit C, or it can be furnished separately to the sheet-folding unit B. A ROM 74 that stores folding execution programs and a RAM 77 that stores control data are provided in the control unit (control CPU) 59. The folding execution program (ROM) 74 executes folding processes with the folding specifications described above by controlling the conveyance roller 25 of the folding process path P2, the conveyance out rollers 27*b*, the folding roller mechanism 21 and the movable stopper 23S. This folding process execution program (ROM) 74 selects whether to move the folded sheet fed into the first discharge path P4 from the first discharge outlet 27*a* to the folded sheet storage tray 29 or to move the folded sheet from the second discharge path P5 to the bookbinding unit C according to the folding specifications, at the same time as executing a folding process described above. The drawings show sheet sizes of A4 or letter size. The sheet is conveyed from the first discharge path P4 and is stored in the folded sheet storage tray 29 for gate fold folding specifications. For other folding specifications, the sheet is conveyed out from the second discharge path P5 to the bookbinding unit C.

When a gate fold is applied to the sheet, the control unit (control CPU) 59 discharges the sheet from the discharge outlet 14 of the image-forming unit A facing downward. The sheet is handed over and conveyed into the folding process path P2 in the manner indicated by arrow a in FIG. 2. Next, the sheet passes through the folding roller mechanism 21 and advances into the switchback path 22 downstream. At the point where the leading edge of the sheet is conveyed a predetermined amount downstream, the switchback roller 22*f* is driven in reverse while the conveyance roller 25 is stopped. At that point, the trailing edge of the sheet is restrained by the conveyance roller 25, and the center of the sheet is bowed in the direction of the nipping point Np1 between the first and second rollers 21*a* and 21*b*. The sheet is nipped between the both rollers, and the first folding process is executed therebetween. By adjusting the distance between amount of feeding of the switchback rollers 22*f* and the nipping point N2, the outside folding position N in FIGS. 4(*b*), (*c*) is set.

Specifically, the sheet sensory detects the leading edge of the sheet, the control CPU59 rotates the switchback roller 22*f* in reverse after an estimated amount of time after that signal for the sheet folding position N2 to reach the nipping point Np1. At that time, the leading edge of the sheet is folded between the second rollers 21*a*, 21*b* at the folding position N2 facing outward.

In this way, the sheet folded to face outside is fed to the folded sheet path 23 by the first and second rollers 21*a*, 21*b*. At this time, the CPU59 moves the movable stopper 23S using a drive motor, not shown, to align the distance of the sheet folding position and the nipping point Np2 to the inner folding position N2 (see FIG. 4) set according to the sheet size.

Therefore, the leading edge (the folded position) of the sheet folded by the first folding unit Np1 abuts the movable stopper 23S and the center portion of the sheet is nipped between the first and second rollers 21*b*, 21*c*. The printed surface of the sheet is folded inward by the second and third rollers 21*b*, 21*c* and the distance between the nipping point Np2 and the movable stopper 23S is set to L2 of the length of the sheet, shown in FIG. 4. Therefore, the leading edge of the sheet faces outward and the trailing edge of the sheet is Z-folded inward. Sheets folded in this manner are fed from the second discharge path P5 to the bookbinding unit C where the bookbinding process is performed.

Bookbinding Unit Configuration

The following will now explain the bookbinding unit C that is attached to the image-forming unit A. The bookbinding unit C is composed of a stacker 40 that stacks and aligns printed sheets into bundles; an adhesive applicator means (the bookbinding means) 55 that applies adhesive to the sheet bundle conveyed from the stacker 40; and cover sheet binding means 60 that binds the cover sheet to the sheet bundle applied with adhesive, in the casing 30.

Conveyance Path Configuration

A conveyance path 31 having a conveyance inlet 31*a* linked to the discharge outlet 14 of the image-forming unit A is provided in the casing 30, and the intermediate sheet conveyance path 32 and cover sheet conveyance path 34 are linked from this conveyance path 31 via the path switching flapper 36. The bookbinding path 33 is linked to the cover sheet conveyance path 34 via the stacker 40, and a finishing path 39 is connected to the cover sheet conveyance path 34. The bookbinding path 33 is disposed to traverse the apparatus longitudinally in a substantially vertical direction, and the cover sheet conveyance path 34 is disposed in a direction to traverse the apparatus in a lateral direction.

The bookbinding path 33 and the cover sheet conveyance path 34 mutually intersect (orthogonally); the cover sheet binding means 60, described below, is disposed in the intersection. The conveyance path 31 configured as described above is linked to the discharge outlet 14 of the image-forming unit A to receive printed sheets from the image-forming unit A. Sheets printed with content information (the leaves of sheets), and sheets printed with a title and the like to be used as a cover sheet (hereinafter referred to as a cover sheet) are conveyed out from the image-forming unit A. This conveyance path 31 is branched into the intermediate sheet conveyance path 32 and the cover sheet conveyance path 34, and sort printed sheets to convey them into each path by the use of a path switching flapper 36.

Stacker Configuration

The stacking tray 41 arranged at the discharge outlet 32*b* of the inner sheet conveyance path 32 stacks and stores sheets from the discharge outlet 32*b* in a bundle. As shown in FIG. 2, the stacking tray 44 is composed of a tray member disposed in substantially horizontal posture; a forward and reverse rotating roller 42*a* and conveyance guide 42*b* are furnished there-above. Also, printed sheets from the discharge outlet 32*b* are guided to the stacking tray 41 by the conveyance guide 42*b* and are stored by the forward and reverse rotating roller 42*a*. The forward and reverse rotating roller 42*a* feeds the printed sheet to the leading edge of the stacking tray 41 with a forward rotation. When rotated in reverse, the trailing edge of the sheet is pushed against an aligning member 43 disposed at the trailing edge of the tray (the right edge of FIG. 1) to become aligned. A sheet side aligning means, not shown, is equipped on the stacking tray 41 to align both edges of the printed sheet stored in the tray to reference positions. With this configuration, printed sheets conveyed from the inner-sheet conveyance path 32 are sequentially stacked in the stacking tray 41 and aligned into a bundle shape.

Sheet Bundle Conveyance Means Configuration

Gripping conveyance means 47 are furnished in the bookbinding path 33 to convey a sheet from the stacking tray 41 to a downstream adhesive application position F. As shown in FIG. 3, the gripping conveyance means 47 turns the sheet bundle stacked on the stacking tray 41 from a horizontal posture to a vertical posture, then conveys the sheet bundle to the adhesive application position F by conveying it along the bookbinding path 33 disposed in a substantially vertical direction. For that reason, the stacking tray 41 moves from a stacking position (solid lines in FIG. 3) to the hand-over position (dashed line in FIG. 3), and hands over the sheet bundle to the gripping conveyance means 47 prepared at this hand-over position.

Adhesive Application Unit Configuration

Figure 6A:
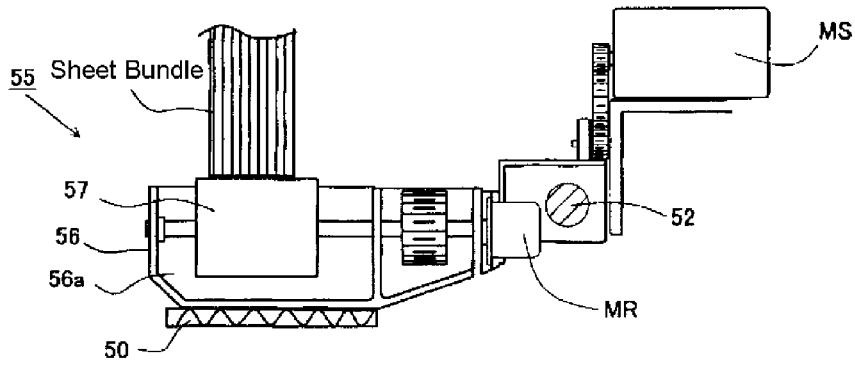
FIGS. 6A and 6B are schematic diagrams of an adhesive application means in the system shown in FIG. 3; 6A shows an adhesive container; 6B shows an application operation.
Figure 6B:
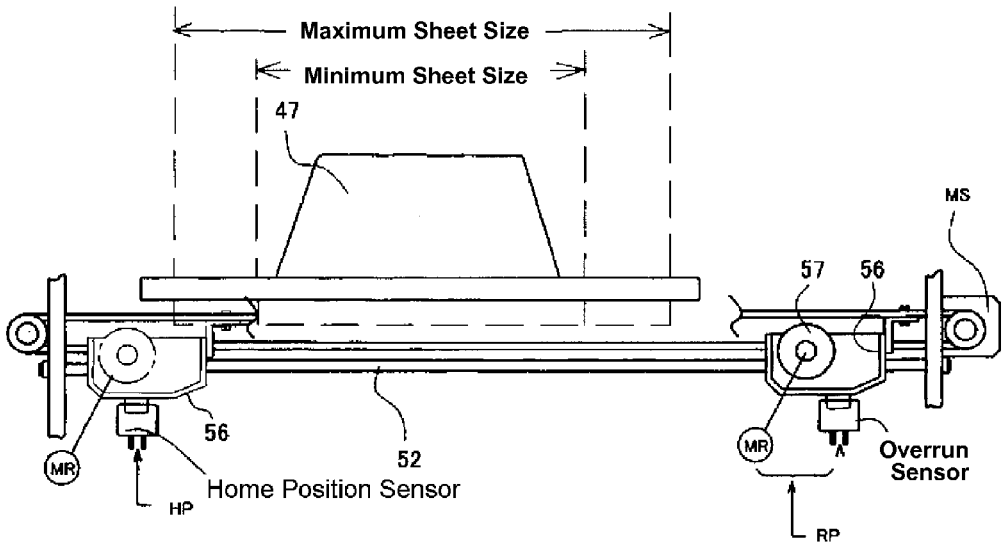

An adhesive application means 55 is disposed in the adhesive application position F of the bookbinding path 33. As shown in FIG. 6(*a*) the adhesive application means 55 is composed of an adhesive container 56 that stores hot-melt adhesive; an applicator roller 57; and a roller rotating motor MR. Adhesive is stored in the adhesive container's 56 liquid adhesive storage chamber. This adhesive impregnates the applicator roller 57 and is applied to a spine edge of the sheet bundle. The symbol 56S in the drawing is the temperature sensor. This maintains a predetermined temperature for liquefaction of the adhesive in the container. Also, heating means 50, such as an electric heater or the like, is embedded in the adhesive container 56. The adhesive container 56 is supported on a guide rail 52 of the apparatus frame to move along the tail edge of the sheet bundle. A drive motor MS installed on the apparatus frame is connected to the adhesive container 56. Therefore, drive motor MS reciprocates the adhesive container 56 between a home position HP and a return position RP where the return operation is started along the sheet bundle.

Cover Sheet Binding Means Configuration

Figure 7:
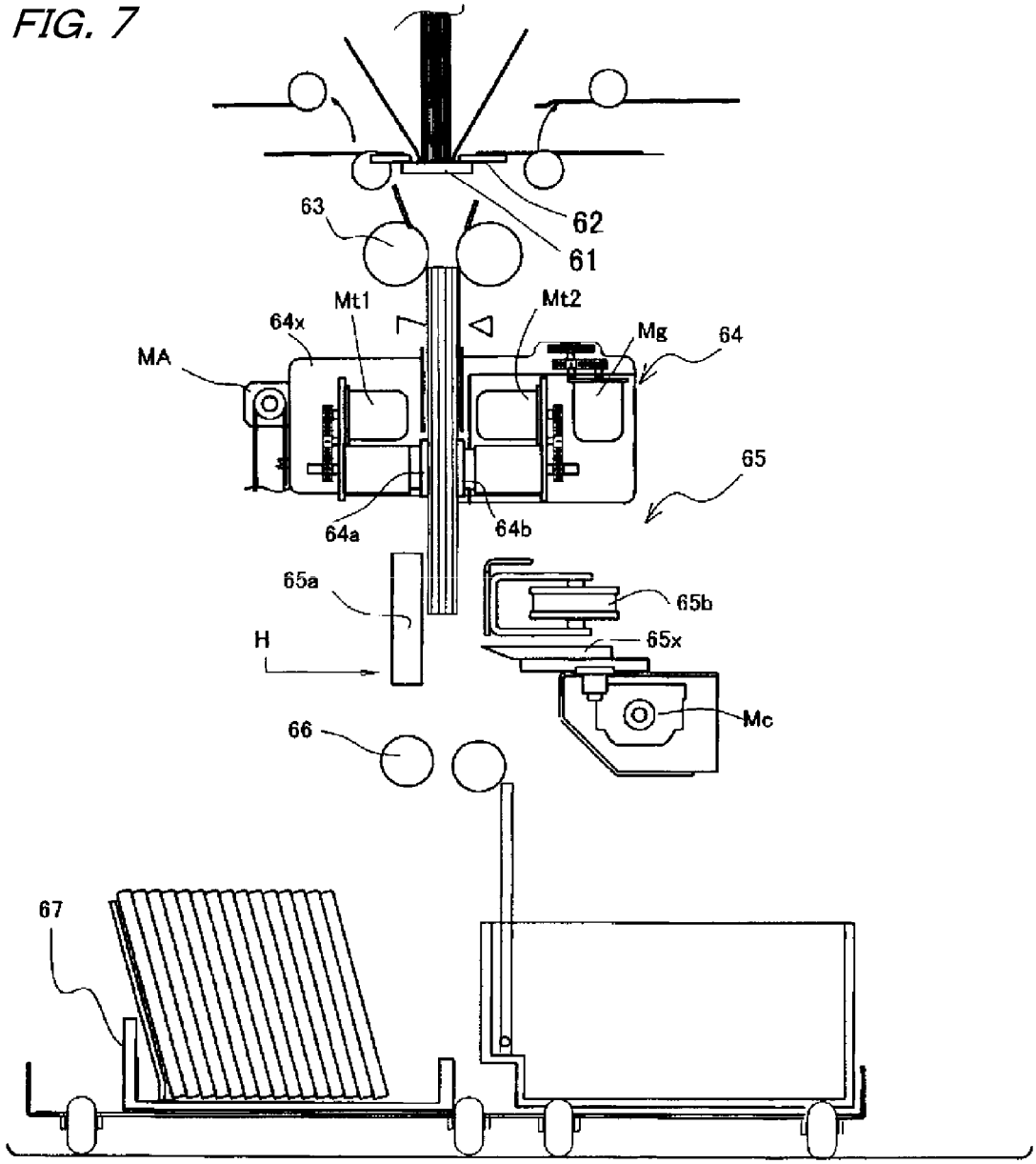
FIG. 7 is a schematic diagram of cover sheet binding means; sheet bundle orientation deviation means; and trimming means in the system shown in FIG. 3.

The cover sheet binding means 60 is disposed in the cover sheet binding position G of the bookbinding path 33. As shown in FIG. 7, the cover sheet binding means 60 is composed of a spine support plate 61, cover sheet folding plates 62, and folding rollers 63. The cover sheet conveyance path 34 described above is disposed in the cover sheet binding position G, and conveys cover sheets from the image-forming unit A or the inserter unit E. The spine support plate 61 is composed of a plate-shaped member that backs-up the cover sheet and is able to advance into and retract from the bookbinding path 33. The inner sheet bundle is joined in an upside-down T-shape to the cover sheet supported on the spine support plate 61. The cover sheet folding plates 62 are composed of a pair of left and right side pressing members. Drive means, not shown, are composed to come together and separate to fold and form the backside of the cover sheet joined in an upside-down T-shape. The folding rollers 63 are composed of are composed of a pair of rollers that finish the cover by sandwiching the sheet bundle joined with the cover sheet.

Bundle-Attitude Biasing Means Configuration

A bundle-attitude biasing means 64 that turns the sheet bundle over from head to tail, and trimming means 65 that cuts the edges of the sheet bundle are disposed in the trimming position H positioned downstream of the folding rollers 63. The bundle-attitude biasing means 64 turns the covered sheet bundle fed from the cover sheet binding position F to a predetermined direction (or posture) and conveys the sheet bundle downstream to the trimming means 65 or the storage stacker 67. The trimming means 65 trims the fringes of the sheet bundle to align the edges. Therefore, the bundle-attitude biasing means 64 is equipped with rotating tables 64*a*, 64*b* that grip and turn the sheet bundle fed from the folding rollers 63. As shown in FIG. 7, the rotating tables 64*a*, 64*b* are established on the unit frame 64*x* installed on the apparatus frame to rise and lower. The pair or rotating tables 64*a*, 64*b* that sandwich the bookbinding path 33 are rotatably supported on bearings in the unit frame 64*x*; one of the movable rotating tables 64*b* supported to move in a sheet bundle thickness direction (a direction orthogonal to the bookbinding path 33). Spinning motors Mt1, Mt2 are furnished in the bookbinding path 33 for the rotating tables 64*a*, 64*b* to change the posture of the sheet bundle. A grip motor Mg is provided for the movable side rotating table 64*b* to move in the left and right directions of FIG. 7.

Therefore, the sheet bundle guided to the bookbinding path 33 is gripped by the pair of left and right rotating tables 64*a*, 64*b*, then the posture of the sheet bundle is changed by the turning motors Mt1, Mt2. For example, the sheet bundle with its spine portion conveyed downward is rotated 180 degrees and fed to downstream discharge rollers 66 with the fore-edge portion facing downward. The sheet bundle is sequentially rotated 90 degrees to turn the sheet bundle's head and tail and fore-edge portion at a downstream trimming position H to enable the trimming of three edge directions of the sheet bundle. Note that a grip sensor (not shown) is provided on the rotating table 64*b* of the movable side. This detects that the sheet bundle has been securely gripped between the left and right side rotating tables 64*a*, 64*b*. After detection, the rotating tables 64*a*, 64*b* are configured to revolvingly drive. Also, the unit frame 64*x* raises and lowers the sheet bundle along the bookbinding path 33 using an elevator motor MA. This is to configure a jog mechanism to offset a predetermined amount the sheet bundle fed by the discharge rollers 66 and convey the sheet bundle to a trimming position H when trimming edges of the sheet bundle, and to set the trimming width at the trimming position H by that feed amount.

Note that the bundle posture changing means 64 is configured to change the posture of the sheet bundle by gripping insertion image areas when gripping the sheet bundle with folded sheets inserted therein. This is to prevent the folded sheets from falling.

Trimming Means Configuration

Trimming means 65 are provided downstream of the bundle posture changing means 64. As shown in FIG. 7, the trimming means 65 is composed of trimming edge pressing member 65*b* that pressingly supports the trimming edge of the sheet bundle to a blade-edge bearing member 65*a* and a trimming blade unit 65*c*. The trimming edge pressing member 65*b* is disposed in a position that opposes the blade-edge bearing member 65*a* disposed in the bookbinding path 33, and is composed of a pressing member that moves in an orthogonal direction to the sheet bundle by drive means, not shown. The trimming blade unit 65*c* is composed of a flat, blade-shaped trimming blade 65*x* and a cutter motor MC that drives that blade. The trimming means 65 with this configuration cuts a predetermined amount around the edges, excluding the spine of the sheet bundle that has been made into a booklet (hereinafter referred to booklet sheets), to align the edges.

Figure 5C:
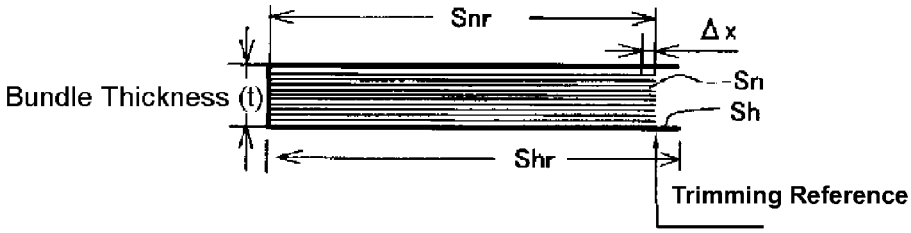
Figure 5D:
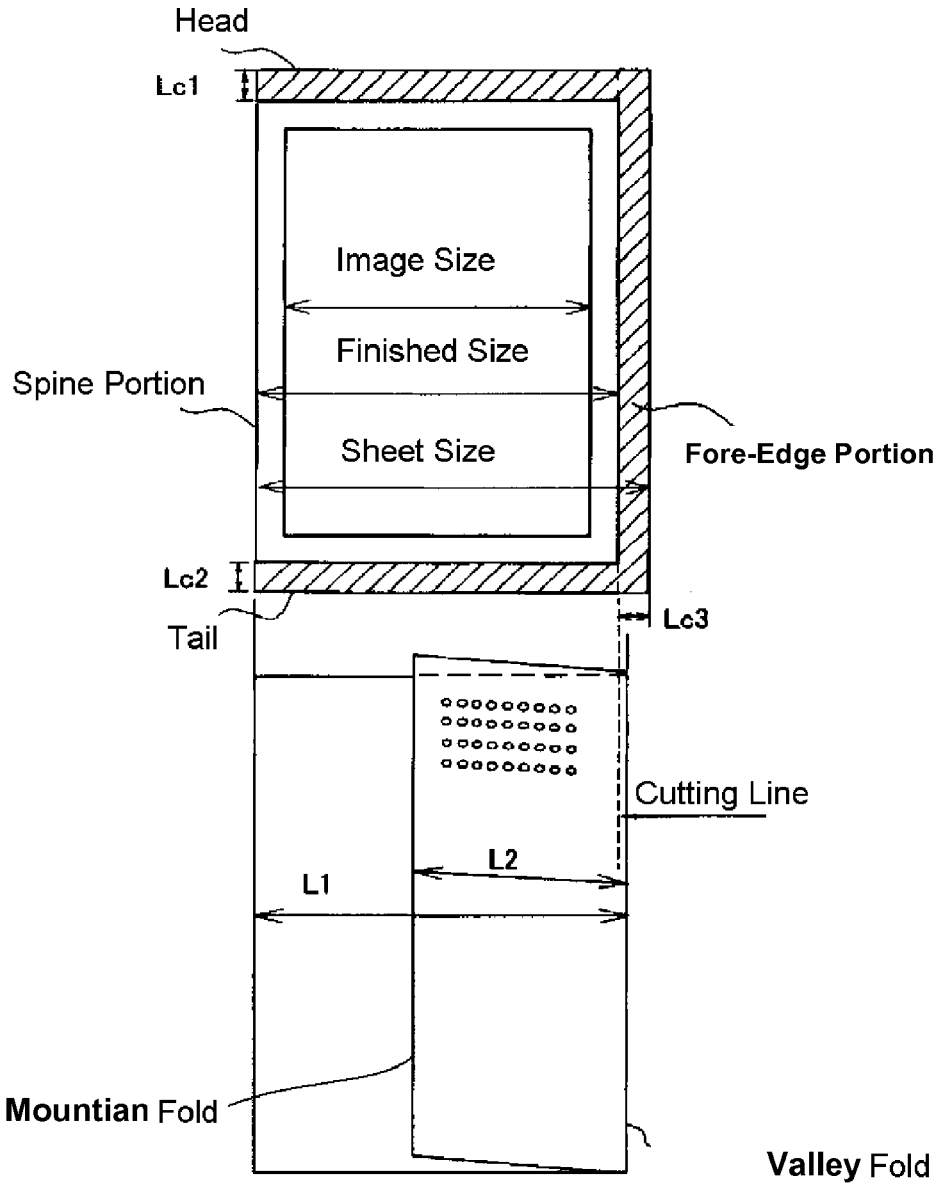

In the trimming to align the booklet sheets, the head portion of the booklet sheets is cut with the trimming amount Lc1, as shown in FIGS. 5C and 5(*d*), then the rotating table 64*b* is turned 180 degrees to cut the tail portion of the booklet sheets with the trimming amount Lc2. These trimming amounts Lc1, Lc2, are calculated by Lc1=Lc2 [[(inner sheet size)−(finished size)]÷2], for example. Next, the rotating tables 64*a*, 64*b* are rotated 90 degrees to cut the fore-edge portion with the trimming amount Lc3. The trimming amount Lc3 is calculated by Lc3=(inner sheet size)−(finished size), for example.

On the other hand the cover sheet trimming amount is calculated in the same way as described above. The trimming amount Ld3 of the foe-edge portion of the cover sheet is calculated by Ld3=[[(inner sheet size)−(bundle thickness)]÷2−(finished size)], for example. The trimming amount Ld of the cover sheet and the trimming amount Lc of the inner sheets are calculated for each, and the longer of the two is set to the trimming position to execute the trimming process. The trimming amount computing means 78, described below, is configured in this way.

Finisher Configuration

The bookbinding unit C is arranged in the finishing unit D. The finishing path 39 is connected to cover sheet conveyance path 34 for the finishing unit D and a finisher, such as a staple unit, punch unit, and stamp unit or the like, is disposed in the finishing path 39*a*. Printed sheets are received from the image-forming apparatus A via the cover sheet conveyance path 34 and stapled, punched or applied with a mark, then conveyed to the discharge tray 37. It is also possible not to apply any finishing process on printed sheets and to store them in the discharge tray 37 directly from the image-forming apparatus A.

Control Means Configuration

Figure 8:
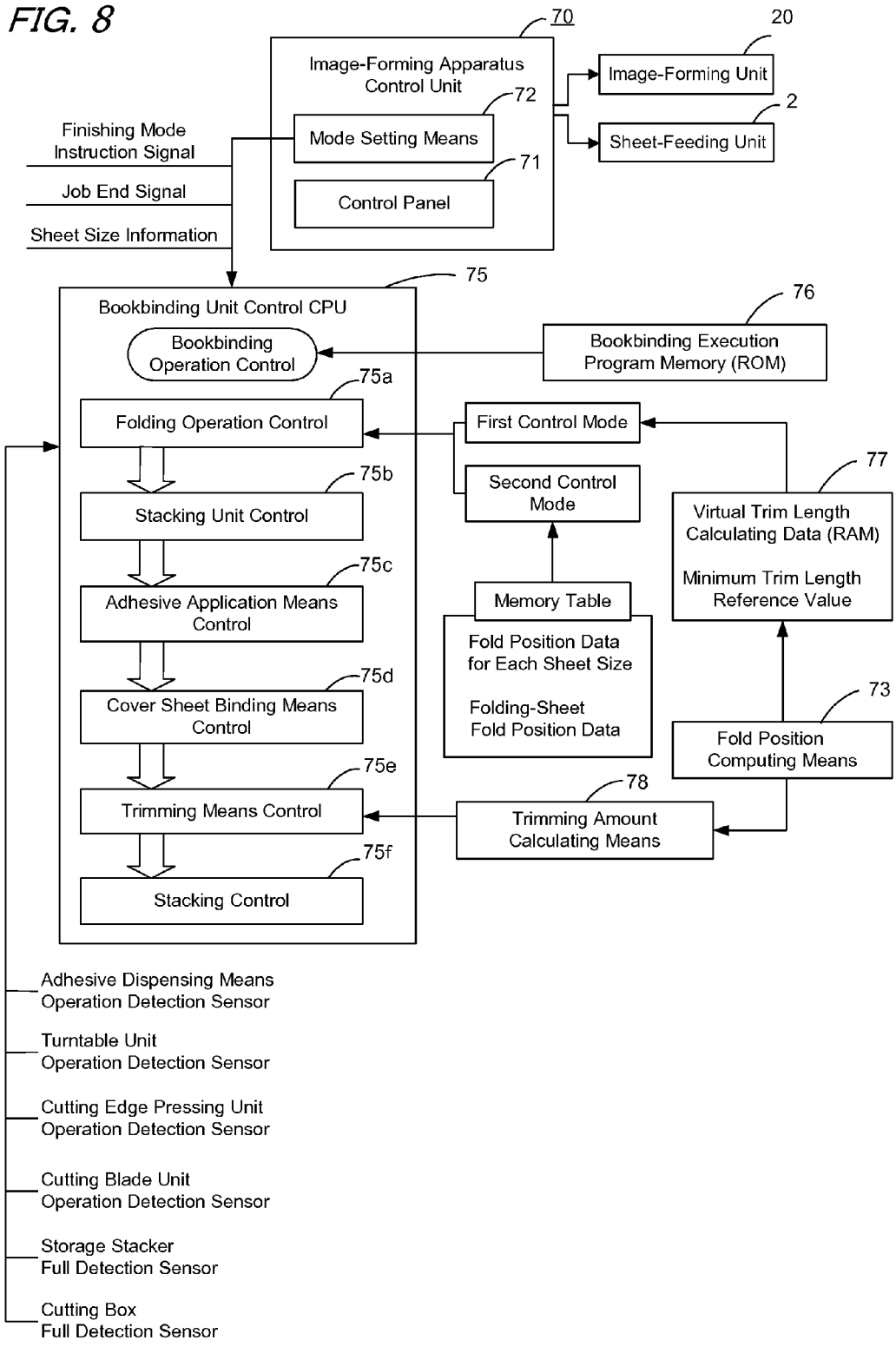
FIG. 8 is a block diagram of a configuration of a control unit in the apparatus shown in FIG. 1.

The configuration of the control means in the apparatus described above will now be explained with reference to FIG. 8. The present invention described above is configured to calculate the folded position according to the trimming amount when sheets are folded to a Z-fold, when the system is set to a mode for bookbinding sheets conveyed from the image-forming unit. FIG. 8 is a block diagram to assist in describing the conveyance of the control means. As shown in FIG. 1, in the system that connects the image forming unit A, the sheet folding unit B and the bookbinding unit C, a control panel 71 and mode selection means 72 are furnished on the control unit CPU70 equipped on the image forming apparatus A, for example. A control CPU75 is provided in the control unit of the bookbinding unit C. This control CPU75 calls up a bookbinding execution program from the ROM76 and executes each process in the bookbinding path 33.

This control CPU75 receives a finishing mode instruction signal, job end signal, sheet size information, and other information and command signals required in the bookbinding process from the control CPU70 of the image-forming unit A. On the other hand, sheet sensors Se1 to Se6 are arranged in the positions shown in FIG. 3 to detect the sheets (sheet bundle) conveyed to the conveyance path 31, bookbinding path 33, and cover sheet conveyance path 34. Detection signals from the sheet sensors Se1 to Se6 are transmitted to the control CPU75; the control CPU75 is provided with "folding operation control unit 75*a*;" "stacking operation control unit 75*b*;" "adhesive application operation control unit 75*c*;" "cover sheet operation control unit 75*d*;" "trimming operation control unit 75*e*;" "stack operation control unit 75*f*;" "folding predetermined position calculating means 73;" and "trimming amount calculation means 78." The bookbinding process is executed according to the flowchart shown in FIG. 9.

Trimming Amount Calculation Means Configuration

The trimming amount calculation means 78 is configured in the control CPU75, and calculates the amount of the edges of the sheet bundle to trim after the bookbinding process. For that reason, the trimming amount calculation means 78 receives the folding specifications information and sheet size information set by the mode on the image-forming unit A from the control unit 70 of the image-forming unit A.

To explain this with reference to FIG. 8, the trimming amount calculation means 78 receives size information of the inner leaves of sheets not folded (hereinafter referred to as inner sheets) and size information of the cover sheet from the control unit 70 on the image-forming unit A.

On the other hand, the trimming amount calculation means 78 receives the bookbinding finishing size information transferred from the image-forming unit A. This finishing size is specified from either of the trimming conditions of whether the size information is what the operator selected such as JIS standard A5 size and the like for example, or a preset trimming amount of "αmm (it is acceptable for the operator to specify 5 mm, for example).

The trimming amount calculation means 78 calculates the (1) inner sheet trimming amounts (hereinafter called the length) Lc1, Lc2 and Lc3 according to the trimming conditions above from that information. The calculating method is as described above when the finishing size is specified. (2) Next, the trimming amount calculation means 78 calculates the cover sheet trimming amount Ld1 (head), Ld2 (tail), and Ld3 (fore-edge portion). In such a case, the bundle thickness of the inner sheets is considered.

Next, the trimming amount calculation means 78 compares the inner sheet trimming amount Lc and cover sheet trimming amount Ld with the head, tail and fore-edge portion sides to set the longest of the inner sheet and cover sheet to the actual trimming amount. Note that such calculation of the trimming amount differs according to the system configuration. For example, if the size of sheet specified by the image-forming unit A is not prepared, and the bookbinding process is executed by printing on a size of sheet that is larger than the specified size and the excess portions are trimmed, it is necessary for the operator to specify "finished size."

Configuration of Folding Position Calculating Means

Next, the folded position calculation means 73 is configured in the control CPU75, and calculates the folded position of the sheets folded at the sheet folding unit B. To explain with reference to FIG. 8, when folding a sheet to a Z-fold, the folded position calculation means 73 calculates the inner-facing folding position N1 and the outer-facing folding position N2, as described above. The length L1 to the spine edge and inner-facing folding position and the length L3 to the front edge portion and outer-facing folding position are calculated. This calculation is done using L1=L3 [[(sheet size)−(binding amount)÷3] when the folding specifications are set to a Z-fold. If the folding specifications are set for ¼ Z-fold, this calculation is done using L1=[(sheet size)÷2], and L3=[(sheet size)÷4]. The present invention has a feature to set the actual folding position from the above calculation values of L1, L3, and the trimming amount (Lc or Ld described above).

In other words, when L1 (the length of the spine edge and the inner-facing folding position) is smaller than the length of the bookbinding finishing size, the calculated folding length is set to the inner-facing folding position N1. Also, when this L1 is L1≧bookbinding finishing size, this is set to L1=(bookbinding finishing size−β). Note that β is set to a preset, arbitrary value, considering discrepancy of the trimming position. By setting to this, the inner-facing folding position N1 (see FIG. 4) is set to a size smaller than the bookbinding finishing size, and the folding position will not be cut off when performing the subsequent trimming process.

Explanation of Bookbinding Operation

Figure 9:
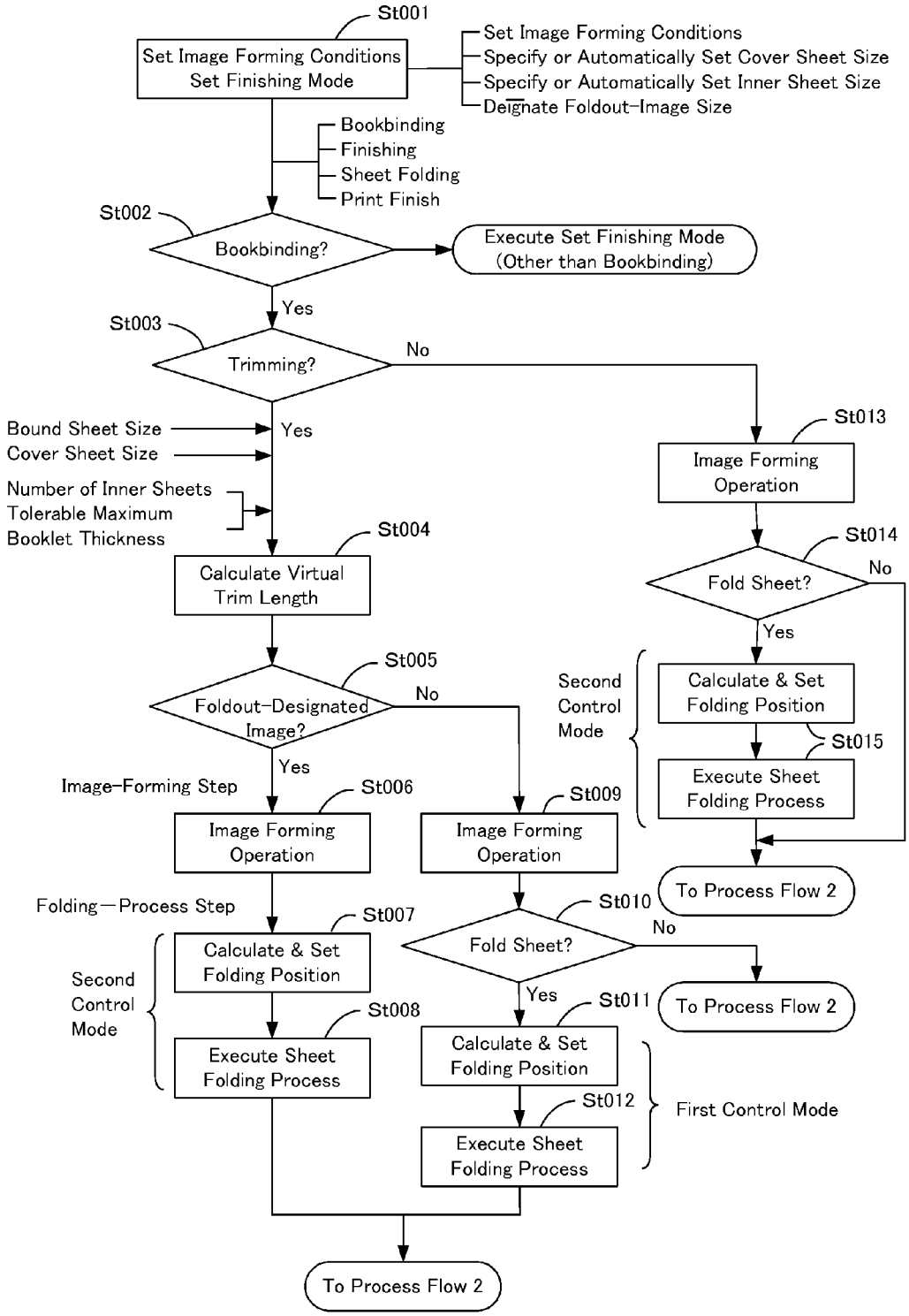
FIG. 9 is a flowchart of the bookbinding operation in the apparatus shown in FIG. 1.
Figure 10:
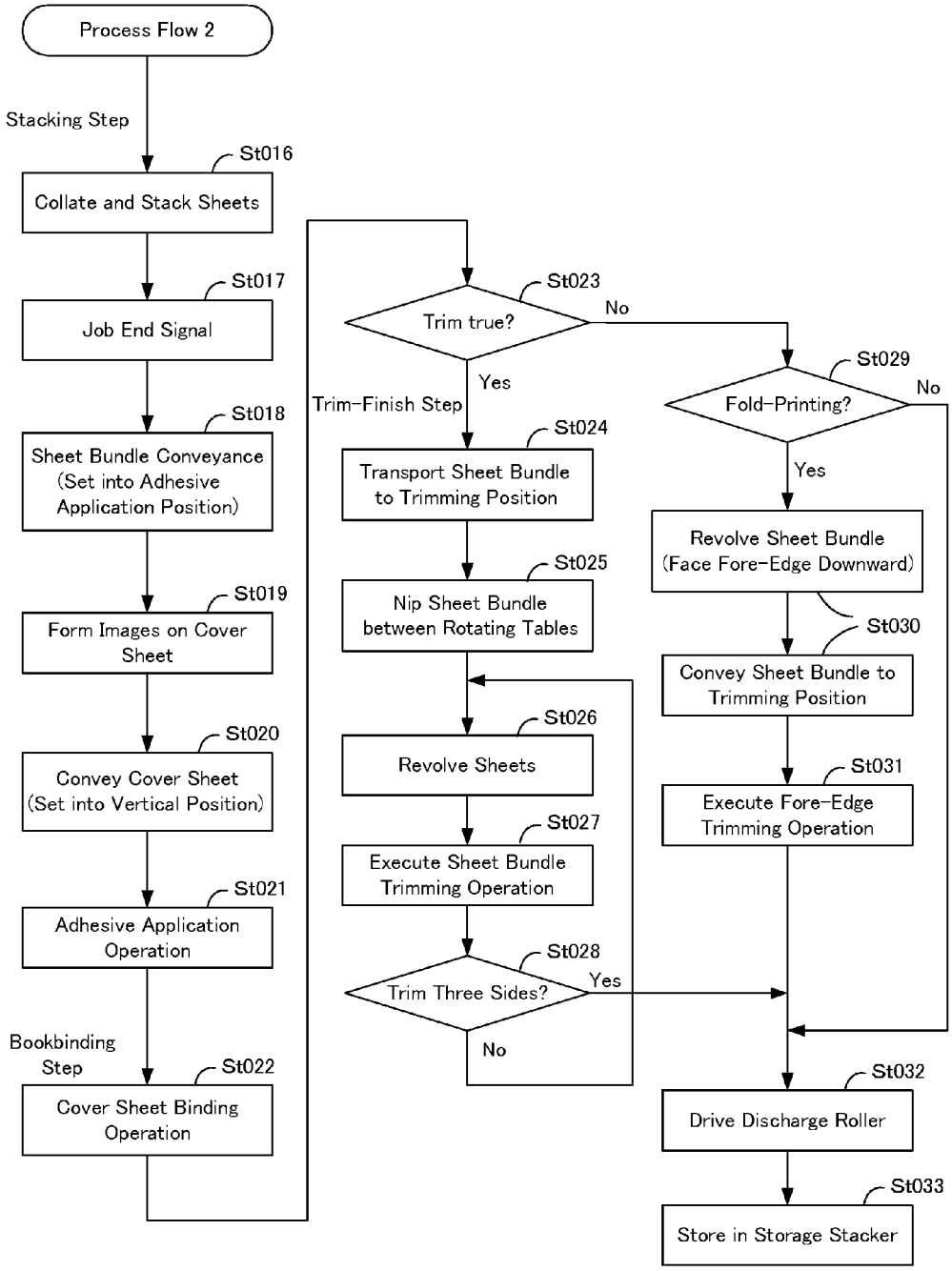
FIG. 10 is a flowchart of the bookbinding operation in the apparatus shown in FIG. 1.

Next, the bookbinding process operations using the control CPU75 will now be explained with reference to the flowchart block diagram of FIGS. 9 and 10. Image forming conditions and a finishing mode are set (St001) using the control panel 71 on the image-forming apparatus A. "Print-out mode," "bookbinding mode," "staple mode," "marking mode," "hole-punching mode," and "jog mode" can be set as the finishing mode, for example. At the same time as this, folding specifications whether to fold the sheet are set according to the sheet size. When the system is set to "bookbinding mode" using the mode setting, the present invention specifies whether to implement "fold-printing" or "fold which image."

In the print-out mode, a sheet formed with an image does not undergo the bookbinding process or the finishing, and is conveyed out to the discharge tray 37 (equipped on the finisher unit D shown in the drawings) and stored. With the bookbinding mode, sheets formed images are aligned and stacked, then joined with a cover sheet and stored in the storage stacker 67. Also, in the staple mode, sheets formed with images are stapled by a stapling unit equipped in the finisher unit D; in the marking mode, a mark is applied; in the hole-punching mode, holes are punched in the sheets; and in the jog mode, sheets are sorted. Each of these modes is executed by the finisher unit D, and then the finished sheets are stored in the discharge tray 37.

The following will now explain a finishing mode when the "bookbinding mode" is selected and fold-printing is specified. When each mode for finishing is set (St001), the control CPU 75 executes each finishing mode specified when the system is set to a mode other than the "bookbinding operation." When the "bookbinding operation" is set, the control CPU75 determines whether trimming was specified (St003).

When the "trimming process" is specified, the control CPU 75 determines whether "fold-printing" was set, though not shown, and if it is not set, the system executes the normal order of operations of forming images, aligning and stacking, bookbinding, and trimming. On the other hand, if "fold-printing" is specified, the control CPU 75 calculates a virtual trimming length (St004). When the apparatus is configured to cover the sheet bundle with a cover sheet, this virtual trimming length calculates the trimming position (see the trimming line in FIG. 4D) when trimming to finish the sheet bundle using the sheet size of the inner leaves of sheets, the cover sheet size and virtual thickness size, and the minimum trimming amount (Δx). The virtual sheet bundle thickness at this time is found using the "maximum tolerable booklet thickness" preset according to the apparatus configuration, or the scheduled number of sheets to print ("the number of inner leaves of sheets"×"average paper thickness"). This virtual trimming length is to set the folding position when folding sheets. The present invention executes a first control mode and a second control mode, described below, according to the virtual trimming length when performing the folding operation.

Next, the control CPU75 determines whether it is a "folding specification image." (St005). Images are formed according to the specified printing conditions (St006) when folding specification images are used. In the forming of images, image data da1 and foldout image data da2 are read out from the image data processor 18*d*, and the series of image data da1 and foldout image data da2 is printed in parallel at the same time. At this time, the control CPU 75 prints foldout images to outside (the fore-end portion of the sheet) the trimming line based on the previously calculated virtual trimming length. Next, the control CPU 75 executes the folding operation on the printed sheet using the sheet folding means 21. The folding position at that time is set to outside the trimming line so the folding position is trimmed based on the virtual trimming length (St007). In other words, the folding position of the sheet folding means is set (second control mode) to within the region of the trimming amount of the virtual trimming means. The sheet is folded at the folding position set in this way. Next, the foldout images are formed and the control CPU 75 sends the folded sheet to be stacked in the stacker 40, described below.

On the other hand, when the system is not set to "folding specification image," the control CPU 75 forms images based on the series of image data da1. (St009) At that time, the control CPU75 determines whether to "fold the sheet." (St010). When the sheet is not folded, the system shifts to the sheet stacking step, described below. The control CPU 75 sets the folding position using the folding position calculating means when the control CPU 75 has determined that the sheet is to be folded. The folding position is set to a position where it is not trimmed when trimming by positioning the folding position within the trimming line based on the virtual trimming length (first control mode).

Then, the control CPU 75 folds the sheet using the sheet folding means 31 according to the folding position set by the first control mode. This sheet folding specification folds the sheet using the folding method specified, such as a single fold or Z fold. The system shifts to the sheet stacking step, described below, for the folded sheet.

On the other hand, the control CPU 75 forms images based on the series of image data da1 when "trimming" is not specified at St003. (St013) Next, the control CPU75 determines whether to "fold the sheet." (St014). When the folding process is not being applied, the system shifts to the sheet stacking step, described below. Also, when folding the sheet, the control CPU 75 executes the folding process according to the specified sheet folding specifications (St015), then the system shifts to the stacking step, described below.

Images are formed in the way described above, and the folded sheet is conveyed from the sheet conveyance path 31 to the stacker 41 (St016). Next, when the job end signal is received from the image-forming unit A, the control CPU75 conveys the sheet bundle on the stacking tray 41 by the gripping conveyance means 47 to turn the sheet bundle posture 90 degrees (St017). This changes the posture of the sheet bundle collated on the stacking tray 41 from a horizontal orientation to a vertical orientation to be conveyed over the bookbinding path 33 to the downstream adhesive application position F (St018).

Approximately the time the sheet bundle is fed and set at the adhesive application position F, images are formed on the cover sheet at the image-forming apparatus A (St019). The control CPU 75 feeds the cover sheet to the cover sheet conveyance path 34. This cover sheet can be fed after being formed with an image at the image-forming unit A, or fed from the inserter unit E.

The sheet fed by the sheet feed path P3 is conveyed to the conveyance path 31. At this time the CPU75 positions the path switching flapper 36 in the state shown in FIG. 1 to guide the sheet to the cover sheet conveyance path 34. A registration mechanism (not shown) is furnished in the cover sheet conveyance path 34 to correct the posture of the sheet; sheets aligned by the registration mechanism are conveyed a predetermined distance from that position to reach the cover sheet binding position G and are stopped there (St020). After the conveyance and setting of the cover sheet, the control CPU75 drives the adhesive application means 55 to apply adhesive to the sheet bundle set at the adhesive application position F (St021). The adhesive container 56 equipped with the applicator roller 57 moves along the tail edge of the sheet bundle to apply adhesive coated on the roller surface onto the sheet bundle.

After finishing the adhesive application operation, the control CPU75 conveys the sheet bundle to the downstream cover sheet binding position G using the gripping conveyance means 47. When this happens, the cover sheet is set at that position so the cover sheet is backed up by the spine support plate 61 and joined to the sheet bundle in an upside-down T-shape. Next, the sheet bundle covered by the folding plates 62 press-forming the backside of the cover sheet.

After the covering process above, the control CPU75 determines whether a trimming mode has been selected (St023). For the trimming mode, the gripping conveyance means 47 releases from the sheet bundle and returns to its default position. A trimming blade 65*x* is positioned at the trimming position H and stops the descending sheet bundle (St024). In this state, the movable rotating table 64*b* moves from the standby position to a sheet gripping position to nippingly hold the sheet bundle between itself and the rotating table 64*a* (St025). Next, after the control CPU75 moves the trimming blade 65*x* to the standby position, it revolves the rotating tables 64*a*, 64*b* 90° to turn the sheet bundle so that its head is at the tail side (St026). There, the trimming edge pressing member 65*b* pressingly holds the sheet bundle and the trimming blade 65*x* cuts a predetermined amount (St027).

At this time, the present invention trims the fore-edge of the sheet bundle last after trimming the head and tail portions when trimming the edges of the bound sheet bundle. Next, the control CPU75 retracts the trimming edge pressing member 65*b* to the standby position, then turns the covered sheet bundle 180 degrees so that the other side is at the tail to trim the tail portion. Next, the control CPU75 retracts the trimming edge pressing member 65*b* to the standby position, then turns the sheet bundle 90 degrees so that the other side is at the tail to cut the tail portion (St028). After the sides of the sheet bundle are cut and aligned in this way, the control CPU75 ends trimming the three directions of the sheet bundle and shifts to the discharge operation.

On the other hand, at step St023 above, if there is no trimming mode selected, the control means 75 shift to the next discharge operation (St029). When "fold-printing" is not included, the system shifts to the discharge operation (St032 and St033). On the other hand, when it is determined that the "fold-printing" is included, the sheet bundle is revolved to face the fore-end portion at the trimming position (St030). Also, the trimming process is executed (St031) to trim free the foldout image. Next, the control CPU 75 stores this sheet bundle in the storage stacker 67 (St032, St033).

The following will now describe the bookbinding method according to the present invention. The system is composed of "image-forming steps" (St006 and St009) to sequentially form images on a plurality of sheets based on predetermined image data da1; a "folding process step" (St008) to fold sheets formed with images; a "stacking step" (St016) that collates sheets formed with images and/or sheets folded in the folding process step; a "bookbinding step" (St022) that binds a spine edge of a sheet bundle collated in the stacking step; and "trimming steps" (St027, St031) that trims at least the fore-edge portion of the sheet bundle bound at the bookbinding step.

Also, at the image-forming step (St006), a foldout image area is set and images are formed on at least one of a series of sheets to be formed with images; at the folding process step (St008), the foldout image area is folded at the folding back position; at the trimming steps (St027, St031), the foldout image area is trimmed at the folding position and separated to fit inside the sheet bundle.

It is to be noted that this application claims priority rights from Japanese Pat. App. No. 2007-182604, which is herein incorporated by reference.

What is claimed is:

1. In an image-forming system, a bookbinding method for collating printed sheets into bundles and binding together the sheet edges along the bundle spine portion, the bookbinding method comprising:

an image-forming step of sequentially forming, based on predetermined image data, images onto a series of sheets;

a fold-process step of folding sheets on which images have been formed in said image-forming step;

a stacking step of collating into bundles sheets on which images have been formed in said image-forming step and/or sheets folded in said fold-process step;

a bookbinding step of binding together spine-portion edges of sheet bundles collated in said stacking step; and a trimming step of trimming true at least the fore-edge of the sheet bundles bound in said bookbinding step; wherein in said image-forming step, on at least a single sheet of the sequential series of sheets on which images are formed, a foldout-image area is preestablished along the sheet's fore-edge portion, and imaging is carried out on the foldout-image area;

in said fold-process step, the foldout-image area is fold-processed along a folding-back fold location; and in said trim-finishing step, said fold location is cut to thereby isolate the foldout-image area, tucked into the sheet bundle.

2. The bookbinding method according to claim 1, wherein in said trim-finishing step:

the periphery of book-bound sheet bundles excluding their spine-bound endface is trimmed true; and in the process of trimming the periphery true, the head and tail portions of a sheet bundle are trimmed true, and then the fore-edge portion is trimmed true finally.

3. The bookbinding method according to claim 2, wherein:

in said image-forming step an image area is preestablished, and a series of images is formed, on sheets of a predetermined size, and an image area and a foldout-image area are preestablished in parallel on sheets of a size larger than the predetermined size, and imaging is carried out on each area; and in said fold-process step the foldout-image area is fold-processed along the folding-back fold location, and said fold location is preestablished so as to substantially coincide with the fore-edge of the sheets of said predetermined size.

4. The bookbinding method according to claim 1, wherein:

in said image-forming step an image area is preestablished, and a series of images is formed, on sheets of a predetermined size, and an image area and a foldout-image area are preestablished in parallel on sheets of a size larger than the predetermined size, and imaging is carried out on each area; and in said fold-process step the foldout-image area is fold-processed along the folding-back fold location, and said fold location is preestablished so as to substantially coincide with the fore-edge of the sheets of said predetermined size.

5. An image-forming system comprising:

a data processor having a series of image data and at least one folding-image data;

image-forming means for forming an image on a sheet based on predetermined image data from the data processor;

sheet folding means for folding a sheet conveyed from the image-forming means;

stacking means for collating and stacking sheets conveyed from the sheet folding means or the image-forming means;

binding means for binding a spine edge of a sheet bundle conveyed from the stacking means;

trimming means for trimming true at least a fore-edge portion of the sheet bundle bound by the binding means; and control means for controlling the image-forming means, folding means and trimming means; wherein the control means is configured (a) to control the image-forming means to sequentially form images on sheets based on the series of image data and to form images of at least one selected image data on the same sheet in parallel to the folding-image data;

(b) to control the sheet folding means to fold, at a folding-back fold location, the sheet formed with the a foldout image; and at the folding step, the foldout-image area is folded at a folding-back fold location; and (c) to control the trimming means to trim at a position to cut free the folding position.

6. The image-forming system according to claim 5, wherein control means controls the image-forming means to form images on sheets of a predetermined size based on the series of image data and to print at least one of the selected image data and folded-image data on a sheet of a larger size than the image data of the predetermined size; and the foldout image is formed at the outside of the sheet of a predetermined size.

7. The image-forming system according to claim 6, wherein the control means sets the folding position to a position where it is not cut by the trimming means when the sheet formed with images based on the series of image data is being folded; and controls the sheet folding means when folding back the foldout image to set that folding position to a position where it is cut free by the trimming means.

8. The image-forming system according to claim 6, wherein the trimming means has sheet bundle orientation deviation means that changes the posture of the bound sheet bundle by gripping it; and the sheet bundle orientation deviation means is configured to change a posture of the sheet bundle by gripping the inserted foldout-image area.

9. The image-forming system according to claim 5, wherein the control means sets the folding position to a position where it is not cut by the trimming means when the sheet formed with images based on the series of image data is being folded; and controls the sheet folding means when folding back the foldout image to set that folding position to a position where it is cut free by the trimming means.

10. The image-forming system according to claim 9, wherein the trimming means has sheet bundle orientation deviation means that changes the posture of the bound sheet bundle by gripping it; and the sheet bundle orientation deviation means is configured to change a posture of the sheet bundle by gripping the inserted foldout-image area.

11. The image-forming system according to claim 5, wherein the trimming means has sheet bundle orientation deviation means that changes the posture of the bound sheet bundle by gripping it; and the sheet bundle orientation deviation means is configured to change a posture of the sheet bundle by gripping the inserted foldout-image area.

12. A bookbinding apparatus comprising:

a sheet conveyance-in path for sequentially supplying sheets;

sheet folding means for folding a sheet conveyed from the sheet conveyance-in path;

stacking means for collating and stacking sheets conveyed from the sheet folding means or the sheet conveyance-in path;

binding means for binding a spine edge of a sheet bundle conveyed from the stacking means;

trimming means for trimming true at least a fore-edge portion of the sheet bundle bound by the binding means; and control means for controlling the folding means and trimming means; wherein the control means is configured to control the sheet folding means to fold the sheet with a foldout image formed at a folding-back fold location along the fore-edge portion of the sheet bundle, and to control the trimming means to trim at a position to cut free the folding-back fold location.

* * * * *